US005718091A

United States Patent [19]

Sellers et al.

[11] Patent Number: 5,718,091

[45] Date of Patent: Feb. 17, 1998

[54] CONSTRUCTION OF A LOG CABIN

[76] Inventors: Jonathan S. Sellers, 108 Vantage La., Hamilton, Mont. 59840; John O. Grady, P.O. Box 692, Custer, S. Dak. 57730

[21] Appl. No.: 621,437

[22] Filed: Mar. 25, 1996

[51] Int. Cl.[6] ..... E04B 1/10

[52] U.S. Cl. ..... 52/233; 144/347; 144/354

[58] Field of Search ..... 52/233; 144/347, 144/354

[56] References Cited

U.S. PATENT DOCUMENTS

| | | | |
|---|---|---|---|
| 4,902,489 | 2/1990 | Garber | 52/233 |
| 5,103,610 | 4/1992 | Walters | 52/233 |

FOREIGN PATENT DOCUMENTS

| | | | |
|---|---|---|---|
| 478868 | 11/1951 | Canada | 52/233 |
| 363705 | 12/1931 | United Kingdom | 52/233 |

*Primary Examiner*—Carl D. Friedman
*Assistant Examiner*—Creighton Smith
*Attorney, Agent, or Firm*—Papan Devnani, Esq.; Thomas A. Powers; Chandrakant Shroff

[57] ABSTRACT

The invention is a method of building structures from tapered logs which have been manufactured in an industrial setting. The logs are stacked crosswise by fitting a notch in a first log, where the notch has a standardized size and shape, over an end of a second log, where the end of the second log has a predetermined size and shape, allowing it to fit into the notch in the first log. Structures built using this method strongly handcrafted structures built from natural logs.

27 Claims, 20 Drawing Sheets

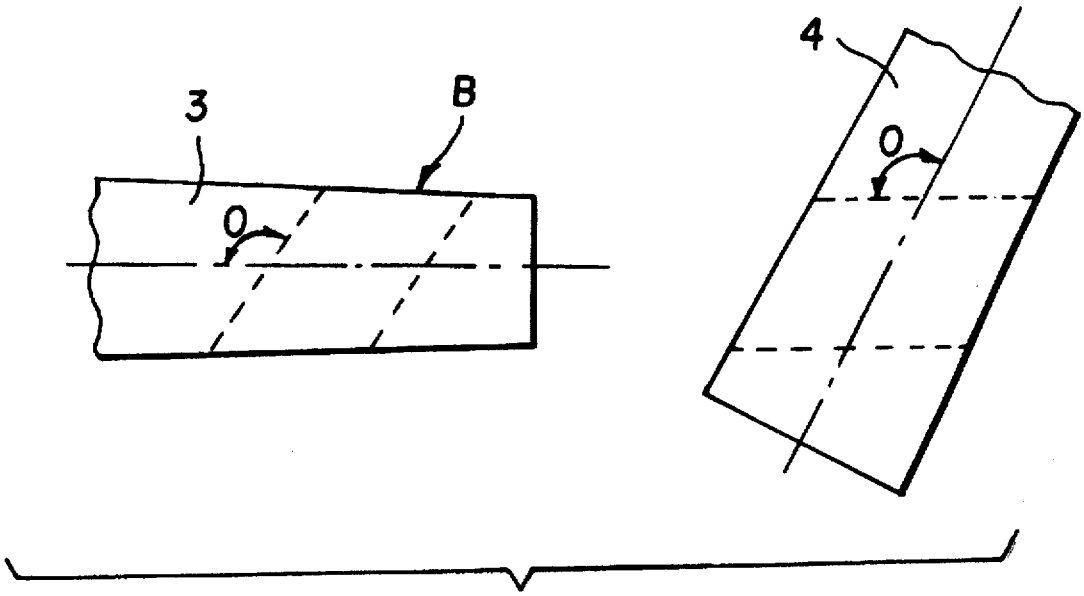
FIG. IC-1
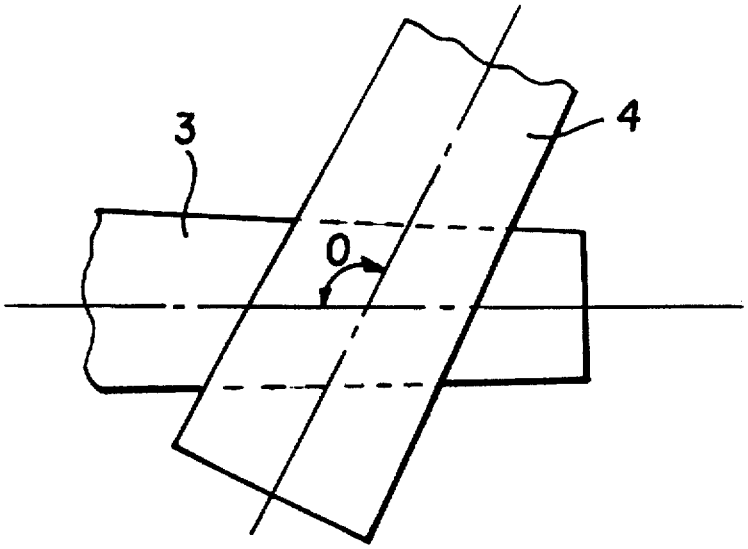
FIG. IC-2

CONSTRUCTION OF A LOG CABIN

FIELD OF THE INVENTION

The field of the invention relates to construction of a house, cabin, or other structure from logs. More specifically, the field of the invention relates to construction of a house or cabin from prefabricated logs which have been prepared in a manufacturing environment.

BACKGROUND OF THE INVENTION

Log cabins have been known and used as dwellings for hundreds of years. The current methods of building a log cabin include construction of a cabin by hand from logs in their natural shape and construction of a cabin from interchangeable prefabricated logs produced in a manufacturing environment. In either method, logs are stacked crosswise to form a four-walled structure. This is done by placing two logs on a flat surface so that they are parallel and separated by a defined distance m. A third log which has two notches which are separated by a distance m, is then placed across the two parallel logs so that it forms a right angle with each of them by fitting one of the two notches over each of the two parallel logs. A fourth log which has two notches separated by a distance n is then placed across the two parallel logs so that it is separated from the third log by a distance p by following the procedure used for the third log. Then two logs, each having two notches separated by distance p, are each placed over one of the first two parallel logs by fitting a first notch over the third log and a second notch over the fourth log. This process is continued until a structure having a desired height is obtained.

In a handcrafted log cabin, each log has a different shape which corresponds to the natural shape of the tree from which it was made. Therefore, whenever two logs intersect to form a corner, the shape of the lower log must be scribed onto the upper log with hand tools. A notch which fits around the lower log must then be carved into the upper log, using the scribed shape of the lower log as a guide for the shape of the notch. Since no two logs have the same shape, notches having a standardized size may not be used. While a great deal of effort is required to build a handcrafted cabin, the resulting structure has an aesthetically pleasing variety due to the presence of logs of differing shapes and diameters.

Construction of a log cabin using interchangeable prefabricated logs is much simpler than handcrafting. All logs are the same size and are shaped as cylindrical logs having a constant diameter d. Each log has two round saddle notches milled into one side, with each notch being adapted to fit around another log of diameter d. Whenever two logs intersect to form a corner, a notch in the first of the two logs is simply placed over the second log. Since all logs have the same shape, notches having a standardized size may be cut into the logs at a factory prior to assembly. However, since all logs have identical shapes and sizes, a structure built using these logs lacks the varied appearance of a handcrafted structure.

There is a long-felt need in the art for a method of building a log cabin which combines the simplicity of construction of a cabin built from prefabricated parts with the beauty of a handcrafted cabin.

SUMMARY OF THE INVENTION

It is an object of this invention to provide a novel method of building structures from machined logs while maintaining the appearance of a handcrafted structure.

It is an further object of this invention to provide a method of constructing a log cabin from prefabricated parts while preserving the varied appearance of a handcrafted cabin.

This will be done by constructing the cabin from prefabricated tapered logs having a large end and a small end. Each log will further have a large notch adapted to fit over the large end of another log milled into its first end and a small notch adapted to fit over the small end of another log milled into its second end. A corner can then be made by fitting the large notch of a first log over the large end of a second log. Similarly, a second corner can be made by fitting the small notch of a third log over the small end of the second log. Since the size of the end of each log is known, the large notch and the small notch may be milled into each log at a factory prior to construction.

Further, the logs in each wall of the cabin will be stacked on top of each other so that the large end of any given log lies between the small end of a log immediately above the given log and the small end of a log immediately below the given log. This alternation of large and small log ends makes the finished wall look as though it was constructed from a mixture of large and small logs. Further, the tapering of the logs makes it look as though each log has a shape which corresponds to the natural shape of the tree from which it was prepared.

DESCRIPTION OF THE DRAWINGS

FIG. 5*a* shows the placement of the first two logs used in construction of a one-room structure, relative to a foundation of length l and width w, while

FIG. 6 shows the logs required to build a foundation or base upon which to build a one-room structure.

FIG. 7 illustrates the construction of a base and shows how subsequent logs may be positioned on the base.

Figures 1, 1A:
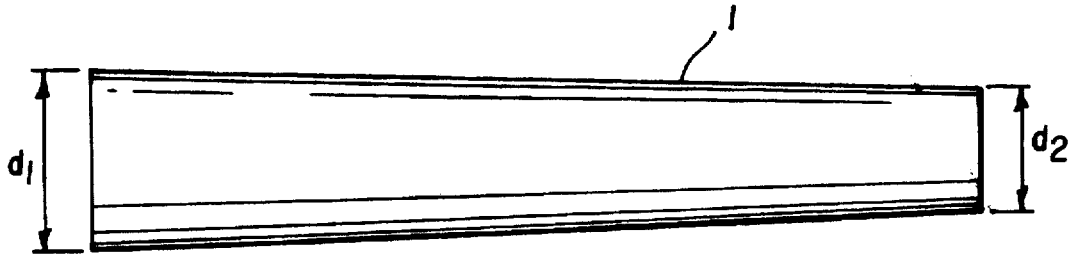
FIG. 1 illustrates the types of prefabricated logs required to build a structure having two intersecting walls, and the method of constructing such a structure.
Figures 1, 1A, 2:
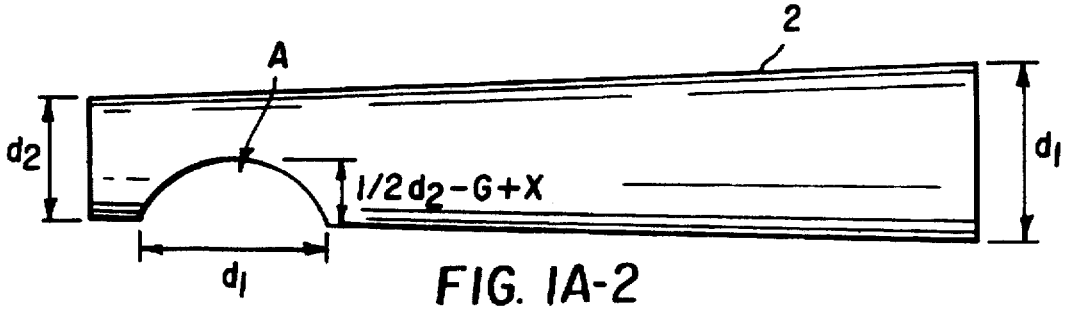
FIG. 2 illustrates a set of base logs which may be used in construction of a two-walled structure, as well as how they are used in construction.
Figures 1, 1A, 2, 3:
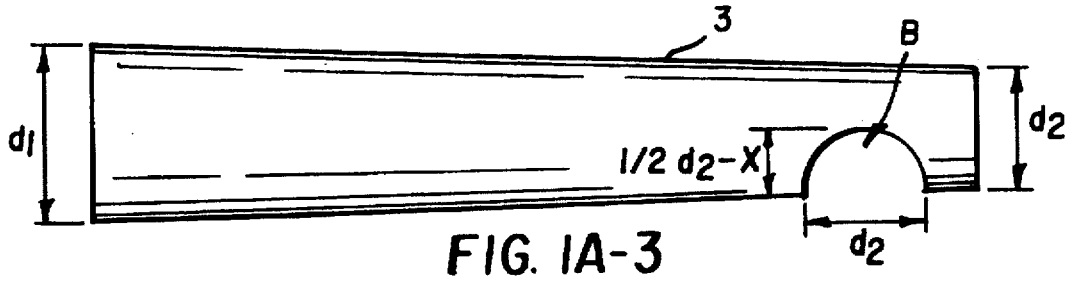
FIG. 3 illustrates the types of prefabricated logs required to build a structure having three walls, and the method of constructing such a structure.

As illustrated in these drawings, any distance from a notch in a log to a second point on the same log (i.e., a distance from a notch to the end of the log) is measured from the center of the notch to the second point. This convention will be followed throughout the following disclosure.

Also, as shown in the drawings, each notch milled into a log is milled into the side of the log at a defined distance y from one end of the log, where y is much less than the length of the log. For the sake of simplicity, any such notch will be hereinafter referred to as being present in one end of the log, rather than as present at a distance y from one end of the log.

DETAILED DESCRIPTION OF THE INVENTION

A) BASIC CONSTRUCTION TECHNIQUES

The current invention provides a method of stacking logs in a crosswise fashion to form a structure having a plurality of walls. The basic method may be illustrated for construction of a structure having two intersecting walls. Construction of such a structure requires the following logs, illustrated in FIG. 1*a*:

a) a first cylindrical log 1 having a large end and a small end;

b) a plurality of second cylindrical logs 2 having a large end and a small end; where the second logs 2 are further characterized in that a large round saddle notch A adapted to fit over the large end of log 1 has been milled into the small end of each log 2;

c) a plurality of third cylindrical logs 3 having a large end and a small end; where the third logs 3 are further characterized in that a small round saddle notch B adapted to fit over the small end of a second log 2 has been milled into the small end of each log 3;

d) a plurality of fourth cylindrical logs 4 having a large end and a small end; where the fourth logs 4 are further characterized in that a small round saddle notch C adapted to fit over the small end of a third log 3 has been milled into the large end of each log 4; and e) a plurality of fifth cylindrical logs 5 having a large end and a small end; where the fifth logs 5 are further characterized in that a large round saddle notch D adapted to fit over the large end of a fourth log 4 has been milled into the large end of each log 5. It is important that each notch make a defined angle θ with the axis of the log into which it is milled, and that this angle be the same for each log (see FIG. 1*c*). Normally, each notch will be a transverse notch which makes a right angle with the axis of the log into which it is milled.

Preferably, logs 1–5 have the same length m, or logs 1, 3, and 5 have a first length n and logs 2 and 4 have a second length o.

The ends of logs 1, 2, 3, 4, and 5 are shaped on a lathe or other machine so that they are cylindrical and have precisely determined diameters. The large end of each log is shaped so that it has a diameter $d_1$; and the small end of each log is shaped so that it has a diameter $d_2$, where d1 is greater than d2. Each small notch B and C is milled by a machine to a precisely determined size which will allow it to fit over a log of diameter $d_2$; and each large notch A and D is milled by a machine to a precisely determined size which will allow it to fit over a log of diameter $d_1$. Preferably, only the ends of logs 1–5 are shaped on a lathe; the central portion of each log is left in its natural shape. This allows the logs to maintain the appearance of natural logs, while allowing notches having standardized sizes to be used in building a log structure. If desired, the entire length of each log may be shaped on a lathe to give each log a precisely defined taper. However, this is less preferred, as mechanically shaped logs do not have the same desirable appearance as natural logs.

Figures 1, 1A, 2, 3, 4:
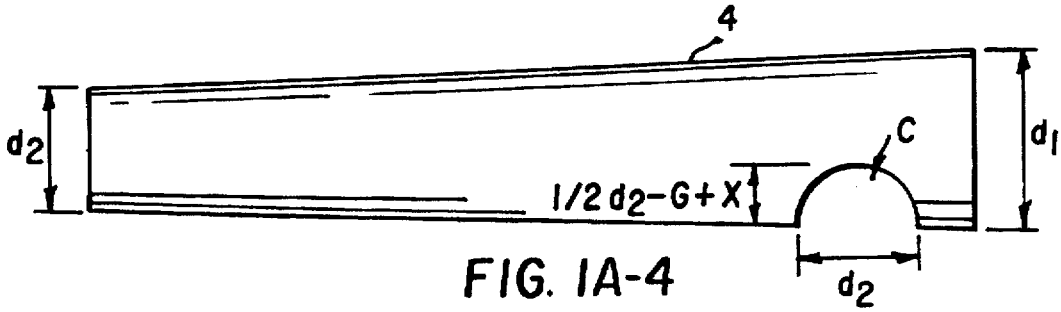
FIG. 4 illustrates the types of prefabricated logs required to build a one-room structure having four walls.
Figures 1, 1A, 2, 3, 4, 5:
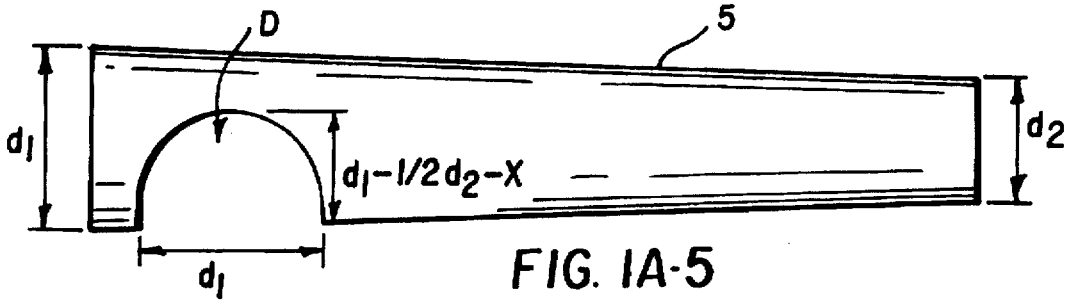
Figures 1, 1B:
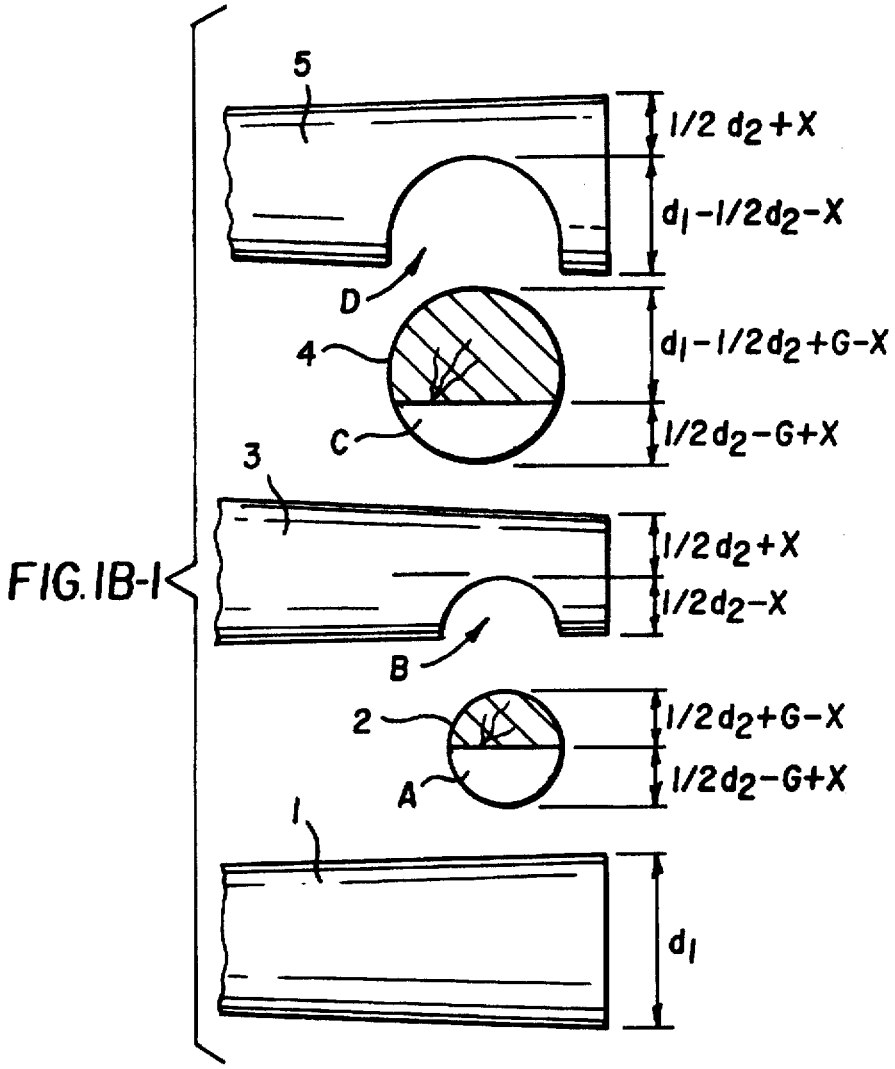
Figures 1, 1B, 2:
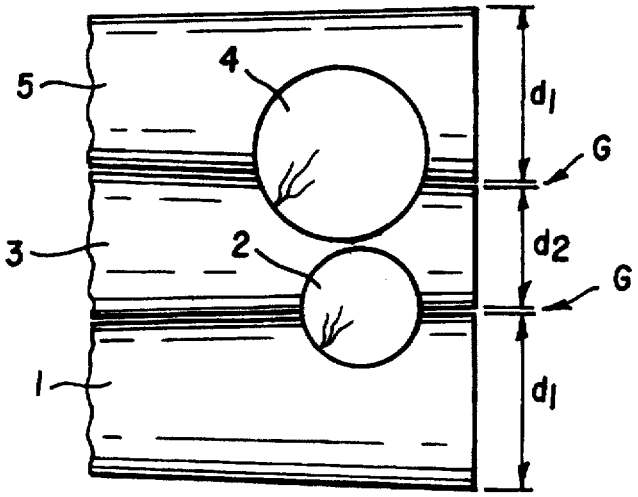

As illustrated in FIG. 1*b*, a structure having two walls may be prepared using the above listed logs by stacking the logs in a crosswise fashion, using the following procedure:

a) placing the first log 1 on a flat surface;

b) stacking one of the second logs 2 on the first log 1 by fitting the large notch A in log 2 over the large end of log 1;

c) stacking one of the third logs 3 on the previously laid second log 2 by fitting the small notch B in log 3 over the small end of log 2;

d) stacking one of the fourth logs 4 on the previously laid third log 3 by fitting the small notch C in log 4 over the small end of log 3; and e) stacking one of the fifth logs 5 on the previously laid fourth log 4 by fitting the large notch D in log 5 over the large end of log 4. The free end of each log (that is, the end which does not intersect other logs) is preferably secured to a log beneath it or to the flat surface to prevent shifting of logs during construction.

When these steps are completed, the first log 1, the third log 3, and the fifth log 5 should be parallel to each other and define a first wall. The second log 2 and the fourth log 4 will be parallel to each other and define a second wall. The first wall and the second wall will intersect at a defined angle θ, where θ is the previously defined angle between the axis of a log, and the notch milled into that log (See FIG. 1*c*). When θ is 90°, the two walls will meet at a right angle. If all logs are the same length, both walls will be the same length. If logs 1, 3 and 5 have a length which differs from that of logs 2 and 4, the walls will have different lengths.

Construction may be continued by repeating steps (b), (c), (d), and (e) sequentially as many times as necessary to obtain a structure which has a desired height. However, it should be noted that each time a new second log 2 is placed on the structure as described in step (b), the large notch A in the second log is fitted, not over a first log 1, but instead over the large end of a fifth log 5 stacked in a previously performed step (e). In the completed structure, the corner where the walls intersect appears to show an attractive alternation of large and small logs, as shown in FIG. 1*b*.

As previously noted, each of the five logs used in construction of the two-walled structure has a diameter $d_1$ at its large end, and a diameter $d_2$ at its small end. Similarly, each large notch is adapted to fit over a log having a diameter $d_1$, and each small notch is adapted to fit over a log having a diameter $d_2$. The notches in the logs may be more specifically characterized in that:

i) the notch A in the second log 2 has a width of $d_1$ and a depth of $\frac{1}{2} d_2 - G + x$, where x is zero or a distance much smaller than $\frac{1}{2} d_2$;

ii) the notch B in the third log 3 has a width of $d_2$ and a depth of $\frac{1}{2} d_2 - x$;

iii) the notch C in the fourth log 4 has a width of $d_2$ and a depth of $\frac{1}{2} d_2 - G + x$; and iv) the notch D in the fifth log 5 has a width of $d_1$ and a depth of $d_1 - \frac{1}{2} d_2 - x$. The parameter G is defined as the size of the gap between two adjacent logs in a wall of a log cabin.

When milling of notches is carried out to these specifications, the logs are able to fit together neatly without obstruction of a notch in one log by another log, as shown in FIG. 1*b*. Thus, when notch C in log 4 is fitted over the small end of log 3, a portion of log 4 having a roughly semicircular cross-section is exposed above log 3. This semicircular portion has a maximum height of $(d_1-\frac{1}{2}d_2-x)+G$, measured from the top of log 3 to the top of log 4, and a width of $d_1$. This allows notch D in log 5, having a depth of $d_1-\frac{1}{2}d_2-x$ and a width of $d_1$, to neatly fit over the exposed portion of log 4, leaving a gap of distance G between log 3 and log 5.

Figures 1, 2A:
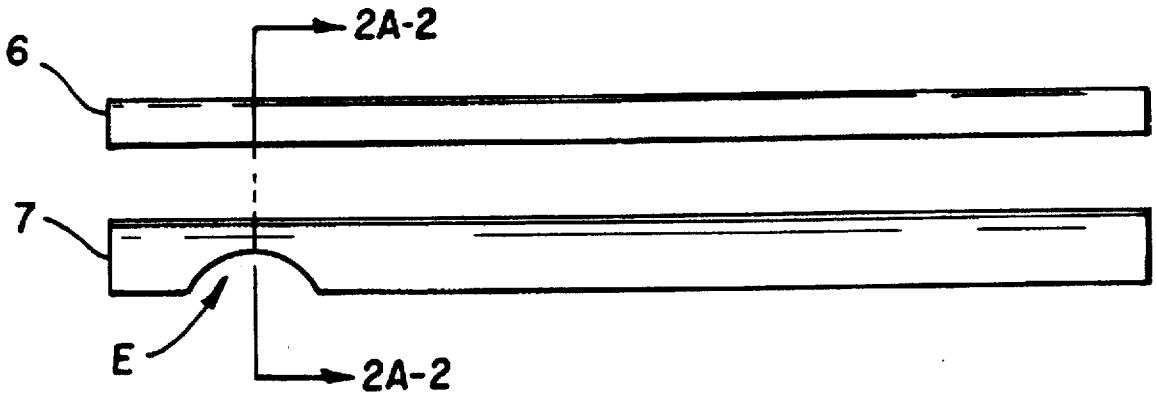
Figures 2, 2A:
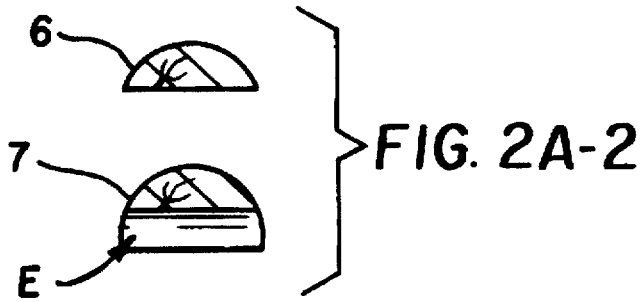

If desired, a set of base logs may be used to provide a firm support upon which to construct a structure. These logs have a flat surface, which helps prevent them from rolling or otherwise shifting during construction. The following base logs, shown in FIG. 2*a*, may be used in construction of a two-walled structure:

a) a first base log 6 having a flat side, a convex side, and a first defined thickness; and b) a second base log 7 having a flat side, a convex side, and a second defined thickness which is greater than the first defined thickness of the first base log. The second base log is further characterized in that a notch E adapted to fit over the convex side of the first base log 6 is present in the flat side of the second base log. The thickness of each base log is the maximum distance from the flat side of the log to the convex side of the log.

Figures 1, 2B:
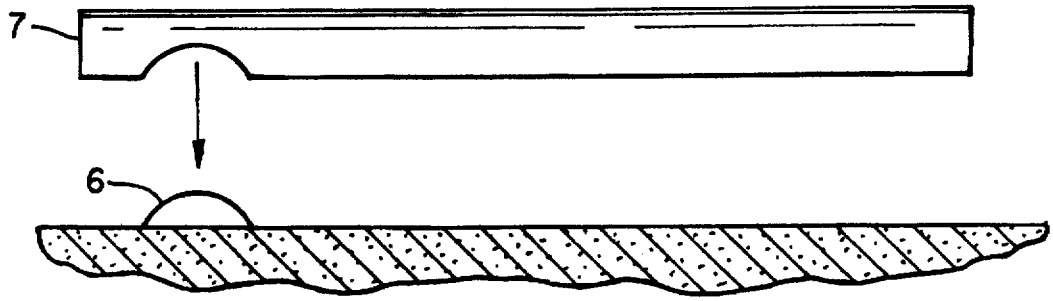
Figures 2, 2B:
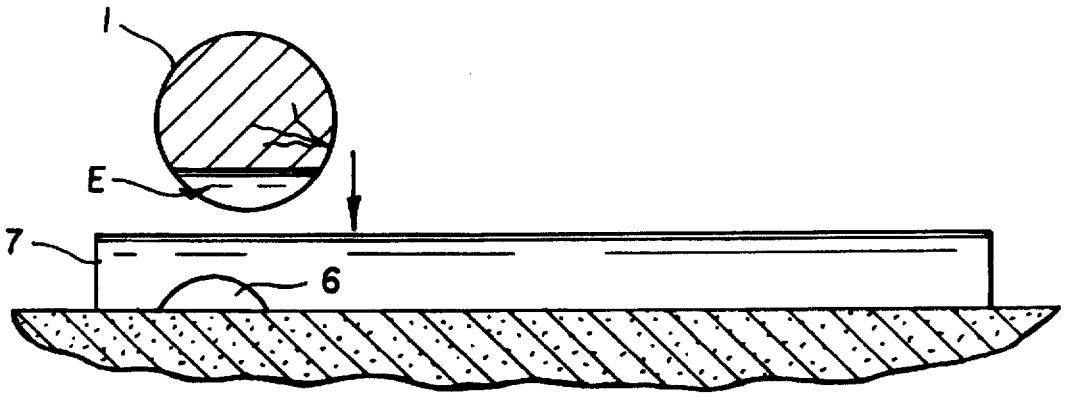
Figures 2, 2B, 3:
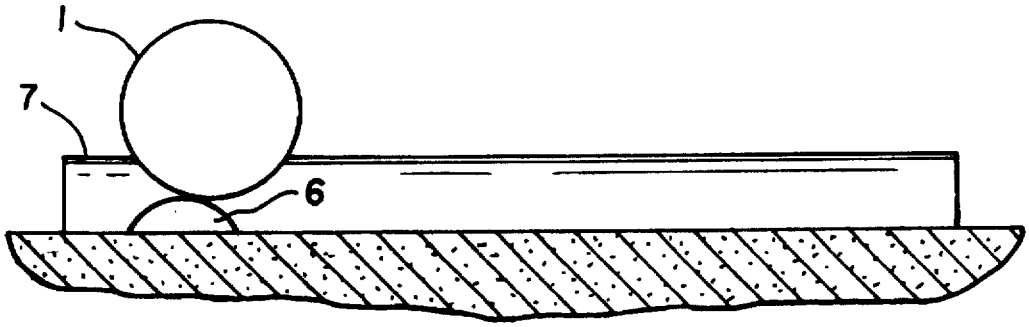

These logs may be used to set up a base for construction of a structure, as shown in FIG. 2*b*. This is done by sequentially:

a) placing the first base log 6 on the flat surface so that its flat side is in contact with the flat surface; and b) placing the second base log 7 on the flat surface so that the flat side of the second base log is in contact with the flat surface and the notch E in the second base log fits over the convex side of the first base log 6.

After the base logs have been laid, the first log 1 is positioned on top of, and parallel to, the first base log 6. This is done by cutting a notch F adapted to fit over the convex side of the second base log 7 into the large end of the first log 1. The first log 1 is then placed on top of the first base log 6 so that the notch F in the first log fits over the convex side of the second base log. Construction then proceeds normally, with the second log 2 being positioned on top of, and parallel to, the second base log 7 so that the notch in the second log is fitted over the first log 1.

Figures 1, 3A:
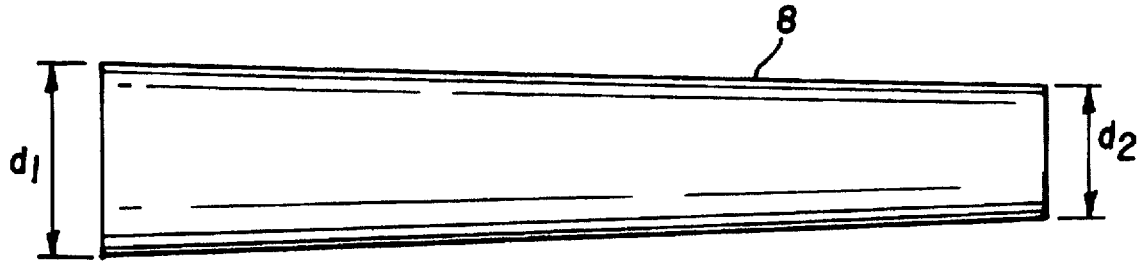
Figures 2, 3A:
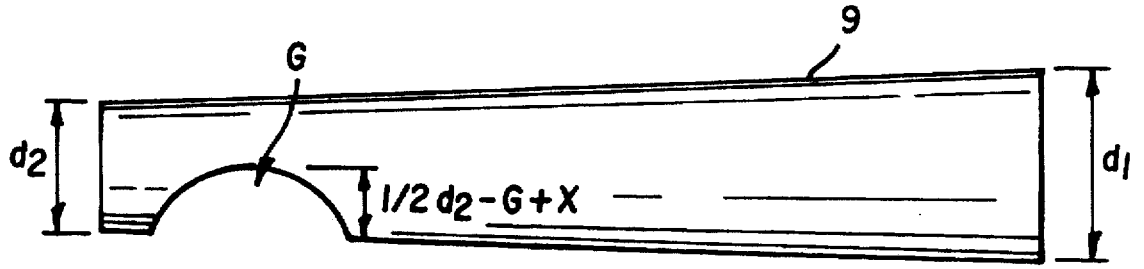
Figures 3, 3A:
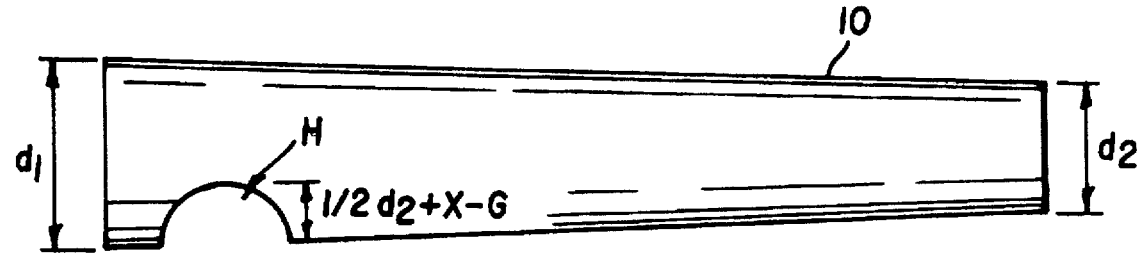
Figures 3, 3A, 4:
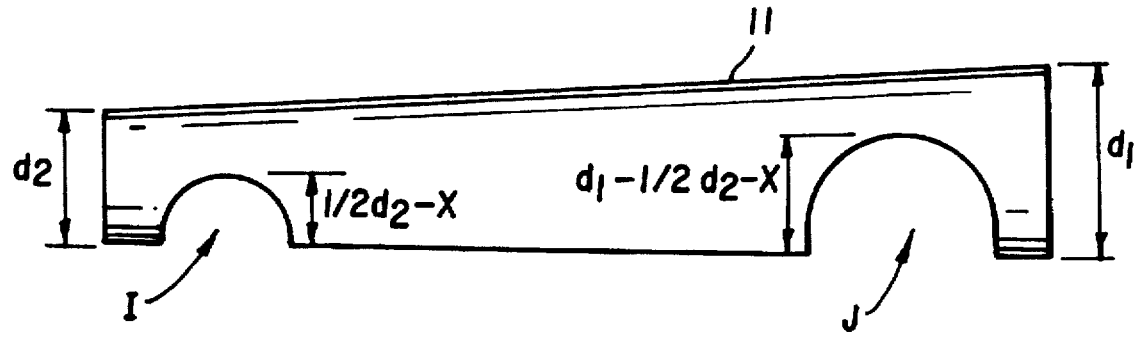

Structures having three or more walls may also be constructed using this method. For example, a three-walled structure may constructed using the following logs (illustrated in FIG. 3*a*):

a) a first cylindrical log 8 having a large end and a small end;

b) a plurality of second cylindrical logs 9 having a large end and a small end, where each second log is further characterized in that a large round saddle notch G adapted to fit over the large end of the first log 8 has been milled into the small end of the second log;

c) a plurality of third cylindrical logs 10 having a large end and a small end, where each third log is further characterized in that a small round saddle notch H adapted to fit over the small end of the first log 8 has been milled into the large end of the third log; and d) a plurality of fourth cylindrical logs 11 having a large end and a small end, where each fourth log is further characterized in that (i) a small round saddle notch I adapted to fit over the small end of the second log 9 has been milled by machine into the small end of the fourth log, and (ii) a large round saddle notch J adapted to fit over the large end of the third log 10 has been milled into the large end of the fourth log. Normally, each notch in the above logs is a transverse notch which forms a right angle with the axis of the log into which it is milled. Preferably, the ends of logs 8–11 have been shaped on a lathe to have predetermined sizes, in the same way that logs 1–5 were shaped. This allows notches having standardized shapes to be mechanically milled into logs 9, 10, and 11.

Figure 3B:
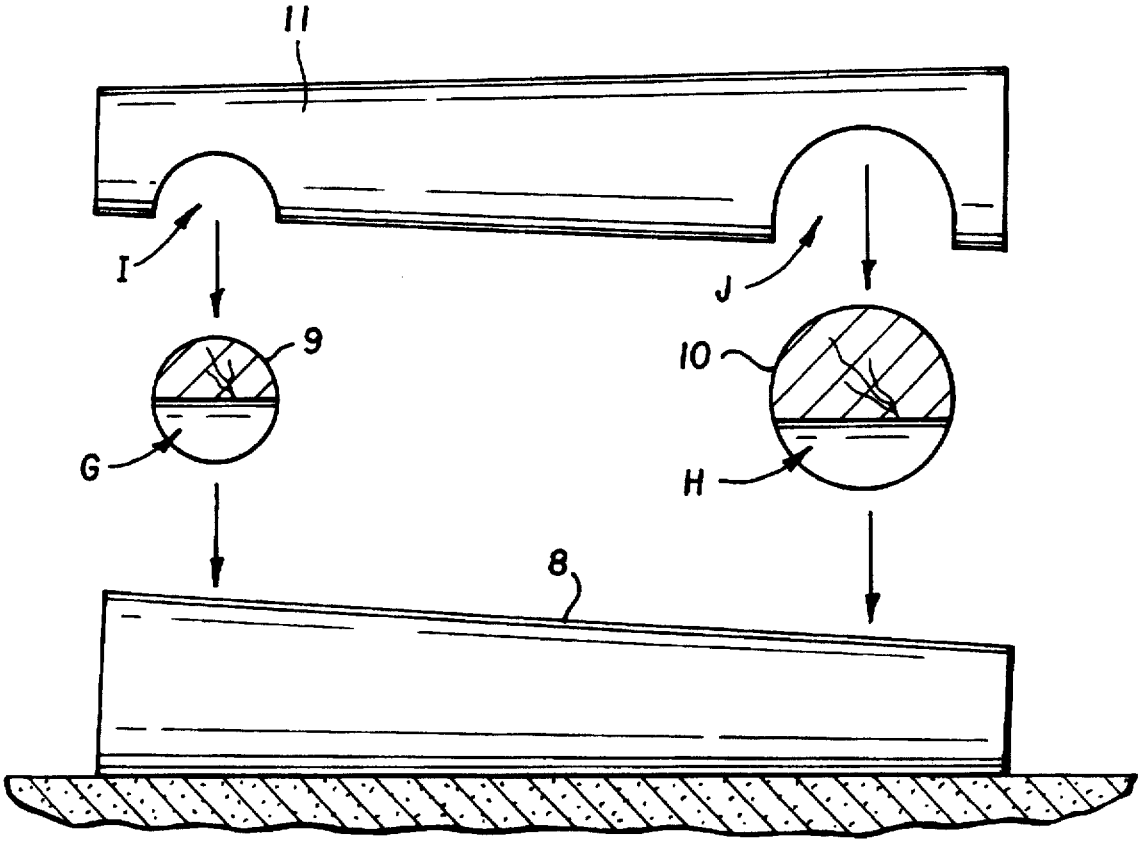
Figure 4A:
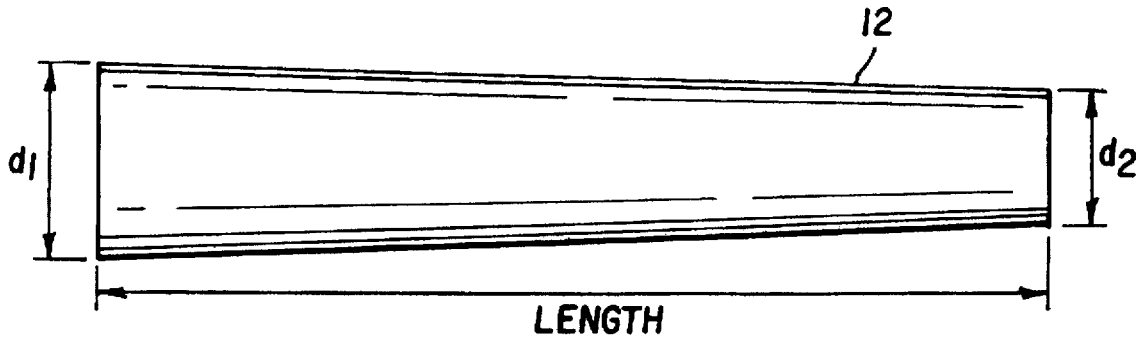
Figure 4B:
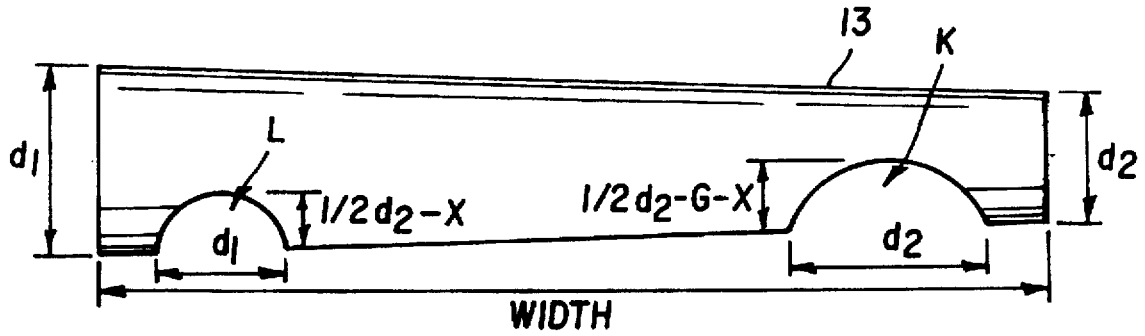
Figure 4C:
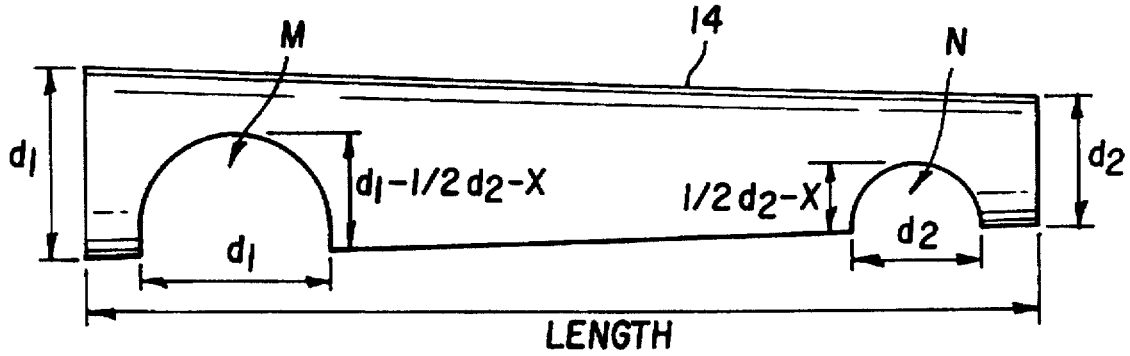

As shown in FIG. 3*b*, a three-walled structure may be prepared from the above logs by the following procedure:

a) placing the first log 8 on a flat surface;

b) stacking one of the second logs 9 on the first log 8 by fitting the large notch G in log 9 over the large end of the first log 8;

c) stacking one of the third logs 10 on the first log 8 by fitting the small notch H in log 10 over the small end of the first log 8; and d) stacking one of the fourth logs 11 on the second log 9 and the third log 10 by fitting the small notch I in log 11 over the small end of the second log 9 and fitting the large notch J in log 11 over the large end of the third log 10.

If additional height is required for the final structure, steps (b), (c), and (d) may be repeated sequentially as many times as necessary to obtain a desired height. However, it must be noted that each time an additional second log 9 or an additional third log 10 is added to the structure, the additional second or third log is positioned over a previously positioned fourth log 11 rather than over the first log 8.

In the final structure, the first and fourth logs (8 and 11) will be stacked on top of one another to form a first wall. The second log 9 intersects the first wall to define a second wall, and the third log 10 intersects the first wall to define a third wall. Assuming that each notch milled into one of the logs makes a 90° angle with the axis of the log into which it is milled, the second wall and the third wall should each form a right angle with the first wall. However, two of the three walls may be constructed so that they do not intersect at a 90° angle. To do this, it is necessary that each notch used in forming a corner between those two walls forms a defined angle θ, where θ is not 90°, with the axis of the log into which it is milled. For example, the second log 9 may have a large notch which forms an angle θ with the axis of log 9 and the fourth log 10 may have a small notch which forms an identical angle θ with the axis of log 10. In this case, when the first, second, and fourth logs are stacked as described above, the first and second walls will intersect at an angle θ.

These techniques are applicable, with minor modifications, to construction of a variety of structures, in addition to the simple two- and three- wall structures described above. Construction of several such structures is described below. However, these examples should not be construed as limiting the scope of the invention to the structures described.

B) CONSTRUCTION OF AN ENCLOSED ONE-ROOM STRUCTURE

The invention additionally relates to a method of building a log cabin from prefabricated logs. The basic set of logs required for construction of a four walled structure, illustrated in FIG. 4, includes:

i) two cylindrical logs of length l 12, where each of the logs 12 has a large end and a small end;

ii) a plurality of notched cylindrical logs of length w 13 which each have a large end and a small end; where a large round saddle notch K is present in the small end of each log 13 and a small round saddle notch L is present in the large end of each log 13; and iii) a plurality of notched cylindrical logs of length l 14 which each have a large end and a small end; where a large round saddle notch M is present in the large end of each log 14 and a small round saddle notch N is present in the small end of each log 14.

These logs are further characterized in that notch K is adapted to fit around either the large end of one of the logs 12 or the large end of one of the logs 14; notch L is adapted to fit around either the small end of one of the logs 12 or the small end of one of the logs 14; notch M is adapted to fit around the large end of one of the logs 13; and notch N is adapted to fit around the small end of one of the logs 13.

In a preferred embodiment, each log 12 has a diameter $d_1$ at its large end and a diameter $d_2$ at its small end, where $d_1>d2$; each notched log 13 has a diameter $d_1$ at its large end and a diameter $d_2$ at its small end; and each notched log 14 has diameter $d_1$ at its large end and a diameter $d_2$ at its small end. The notches in the notched logs are then milled so that they have defined widths and depths. In log 13, notch K has a width of $d_1$ and a depth of $\frac{1}{2} d_2-G+x$, while notch L has a width of $d_2$ and a depth of $\frac{1}{2} d_2-G+x$. In log 14, notch M has a width of $d_1$ and a depth of $d_1-\frac{1}{2} d_2-x$; and notch N has a width of $d_2$ and a depth of $\frac{1}{2} d_2-x$.

The set of logs described above may be used to build a cabin as soon as they are manufactured, or they may be packaged as a kit and sold to a consumer who wishes to construct a log cabin himself.

Figure 5A:
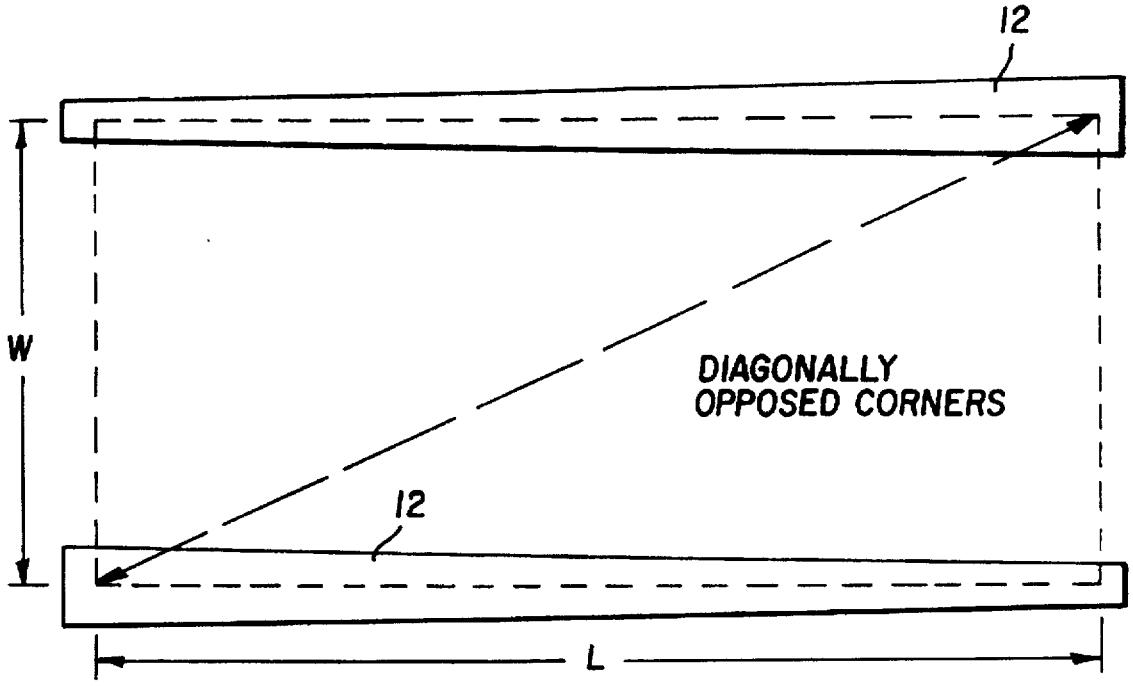

The process of constructing a log cabin from these parts is relatively straightforward. In the first step, a rectangular foundation or base having a length l and a width w is prepared. Next, the two logs of length l 12 are laid along the sides of length l of the foundation. Each log 12 is positioned over a different side of length l of the foundation, and they are arranged so that the large ends of logs 12 overlie diagonally opposed corners of the foundation. Usually, each log 12 is simply placed on a side of the foundation. However, the small end of each log 12 may be supported so as to cause the axis of the log to lie parallel to the plane of the foundation. The position of logs 12 is shown relative to the foundation in FIG. 5*a*.

If desired, the logs 12 may be replaced by two of the notched logs of length l 14. The notched logs 14 should be positioned in the same manner as logs 12, with the added requirement that the notches in the notched logs should each be positioned so that they face downwards, toward a corner of the foundation.

Figures 1, 5B:
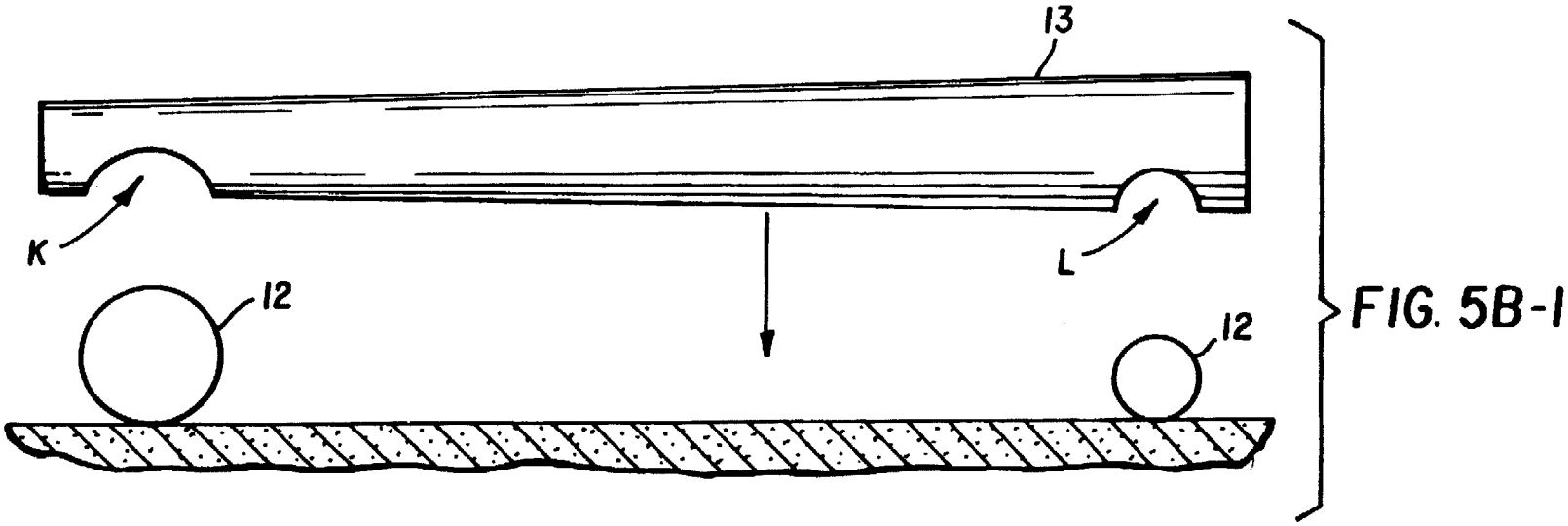
FIGS. 5*b* and 5*c* show how to construct such a structure.
Figures 2, 5B:
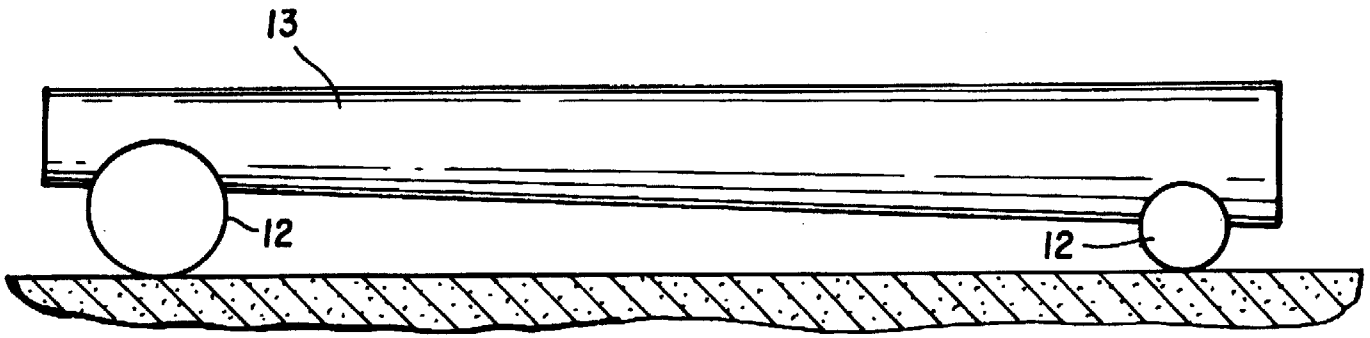

Next, one of the notched logs of length w 13 is laid along a first side of length w of the foundation by fitting small notch L over the small end of a first previously laid log 12 and fitting large notch K over the large end of a second previously laid log 12, as shown in FIG. 5*b*. This process is then repeated for a second notched log 13. The second notched log 13 is laid along the other side of length w of the foundation by fitting notch L of the second log 13 over the small end of the second previously laid log 12 and fitting large notch K of the second log 13 over the large end of the first previously laid log 12. Since the large ends of the two previously laid logs 12 overlie diagonally opposed corners of the foundation, the small ends of the two notched logs 13 (that is, the ends into which large notches K have been milled) must also overlie diagonally opposed corners of the foundation to obtain a proper fit.

Figures 1, 5C:
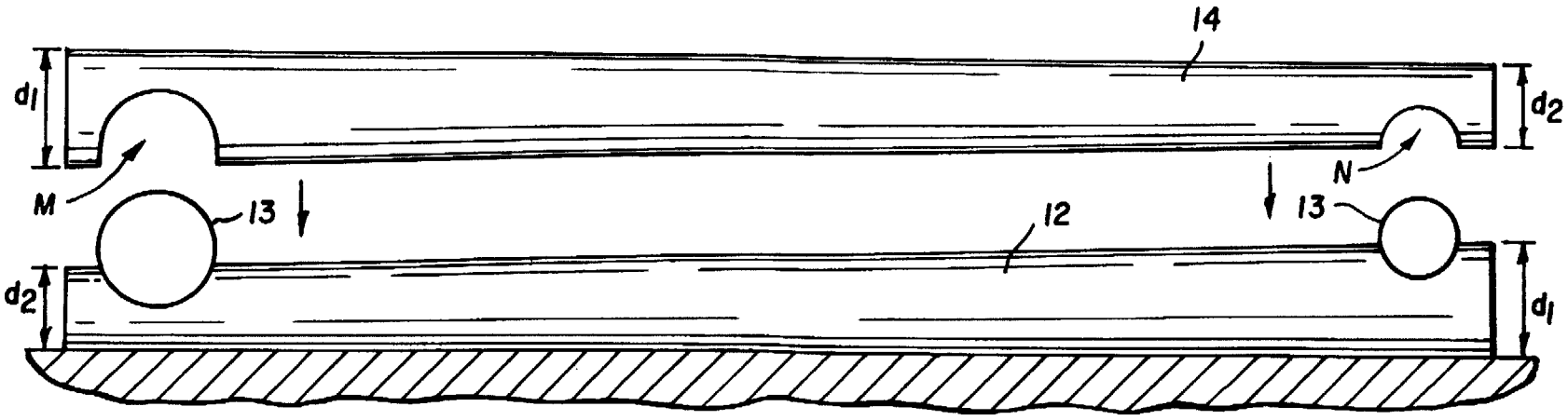
Figures 2, 5C:
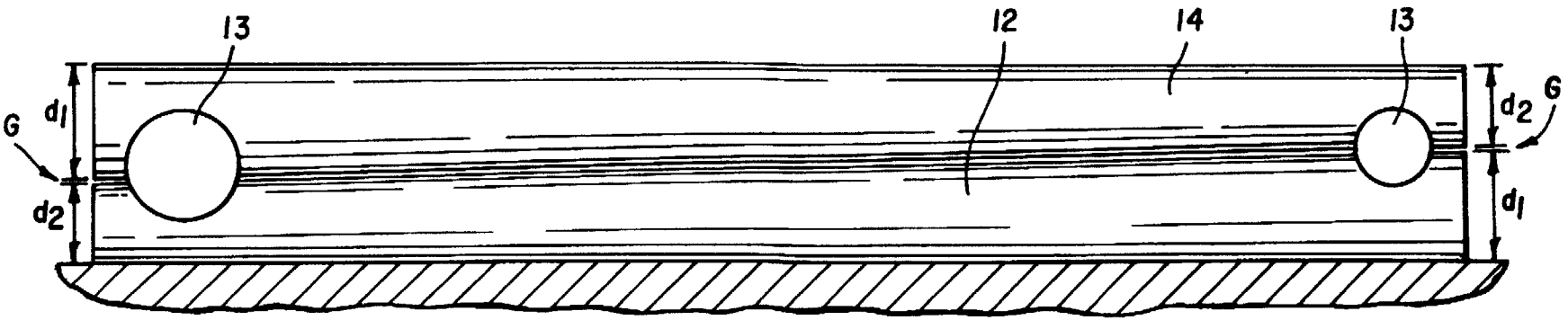

Next, two notched logs of length l 14 are positioned immediately above, and parallel to, the two previously laid logs 12 by fitting small notch N of each log 14 over the small end of one of the previously laid logs 13, as shown in FIG. 5*c*. Large notch M of each log 14 is then fitted over the large end of the other of the previously laid logs 13. Each of the logs 14 overlies a different one of the logs 12. Further, it will be noted that each notched log 14 is separated from the log 12 immediately beneath it by a distance G, and that the small end of each log 14 overlies the large end of a log 12, as shown in FIG. 5*d*. Two additional notched logs of length w 13 may then be placed over the two previously laid notched logs of length w 13 by fitting small notch L of each additional log 13 over the small end of one of the previously laid logs 14, and fitting large notch K of each additional log 13 over the large end of the other of the previously logs 14. This process may be continued, with two notched logs 14 and two notched logs 13 being laid sequentially as many times as necessary to obtain a structure having the desired height. In the resulting structure, the walls meet at corners which exhibit apparent alternation between large and small logs, with each pair of adjacent logs in a given wall being separated by a gap distance G, much like that seen in FIG. 1*b*. The size of the gaps between logs may be controlled by controlling the size of G when milling notches M and N into logs 14.

Once construction of the basic four-walled structure has been completed, openings suitable for use as windows and doors may be cut into the walls of the structure. However, if any logs are cut completely through in this process, the cut end of each log will have to be secured to the logs immediately above it and below it to prevent shifting of the logs.

The previously mentioned step of preparing a foundation or base will now be more fully described. A flat surface is selected and used as the foundation of the cabin. A set of base logs may be positioned on the foundation to provide a firm, non-shifting base for further construction. These logs include:

i) two base logs of length l 15, where each base log 15 has a flat side, a convex side, and a defined thickness; and ii) two base logs of length w 16, where each base log 16 has a flat side, a convex side, and a defined thickness, with the defined thickness of logs 16 being greater than the defined thickness of logs 15.

Figures 1, 6A:
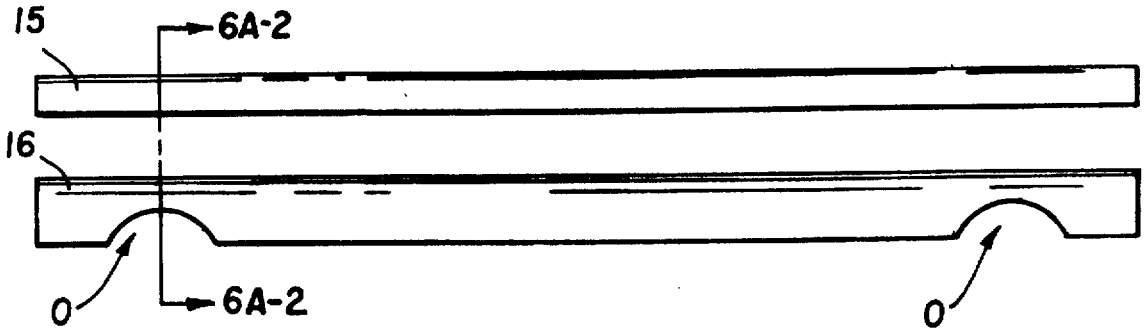
Figures 2, 6A:
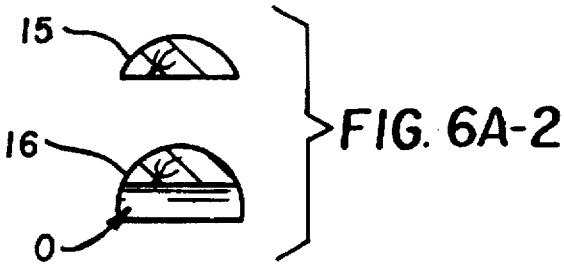

The base logs 16 are further characterized in that two notches O are present in the flat side of each log 16, where one notch O is present at each end of log 16. Each of the notches O is adapted to fit over the convex side of a base log 15. The base logs are illustrated in FIG. 6. If the logs used in the construction method of this invention are packaged as a kit and sold to a consumer, the base logs may be included in the kit with the previously described logs 12, 13, and 14.

The first step in preparing the foundation is defining a flat rectangular area of length l and width w. Next, a first base log of length l 15 is laid over a first side of length l of the rectangular area, and a second base log 15 is laid over a second side of length l of the rectangular area. The base logs 15 are placed so that the flat side of each log 15 is flush with the surface of the rectangular area.

Figures 1, 7A:
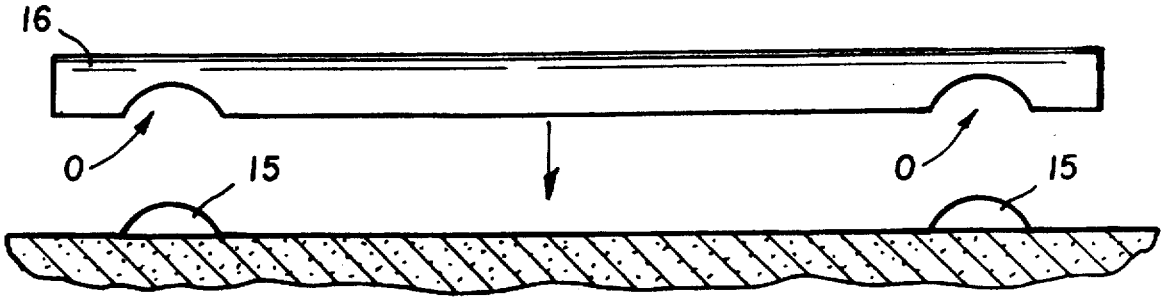
Figures 2, 7A:
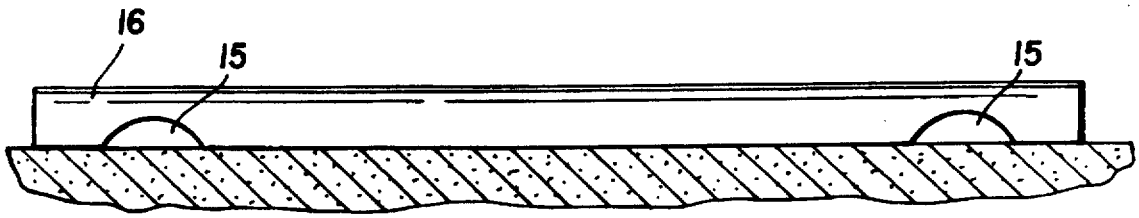

Next, a first base log of length w 16 is laid over a first side of length w of the rectangular area by fitting one of the notches O in the flat side of the first base log 16 over the first previously laid base log 15 and fitting the other notch O in the flat side of the first log 16 over the second previously laid base log 15. A second base log 16 is then laid over a second side of length w of the rectangular area by fitting the notches O in the flat side of the second log 16 of length w over the previously laid base logs 15, exactly as described for the first base log 16. This step is shown in FIG. 7*a*.

If desired, the base logs of length l 15 may each have a first end and a second end, where the first end is thicker than the second end. Similarly, each base log of length w 16 may also have a first end which is thicker than its second end. If base logs having varying thicknesses are used, it is necessary that one of the notches O in the flat side of each base log 16 be adapted to fit over the thicker end of a base log 15, and that the other of the notches O in the flat side of each base log 16 be adapted to fit over the thinner end of a base log 15. Preferably, a notch O which is adapted to fit over the thinner end of a log 15 should be milled into the thicker end of each base log 16. Similarly, a notch O which is adapted to fit over the thicker end of a log 15 should be milled into the thinner end of each base log 16.

A foundation or base is prepared from base logs having varying thicknesses exactly as described for base logs having constant thicknesses. The chief difference is that the builder can no longer fit a given notch O in a log 16 over either end of a previously laid log 15. Each base log 16 must be fitted into position by fitting the notch O which is adapted to fit over the thinner end of a base log 15 over the thinner end of one of the previously laid logs 15, and fitting the notch O which is adapted to fit over the thicker end of a base log 15 over the thicker end of the other previously laid base log 15. In order to obtain a proper fit, the thicker ends of the base logs of 15 must overlie diagonally opposed corners of the flat rectangular area.

Figures 1, 7B:
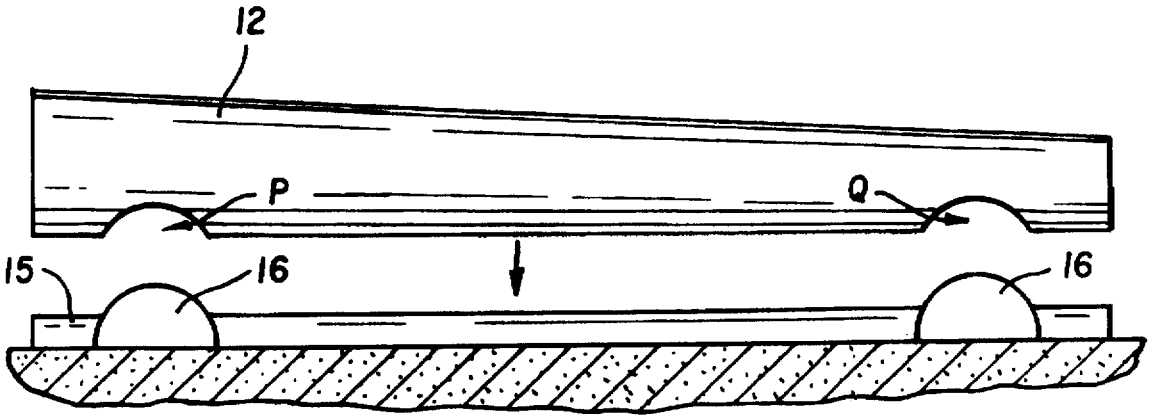
Figures 2, 7B:
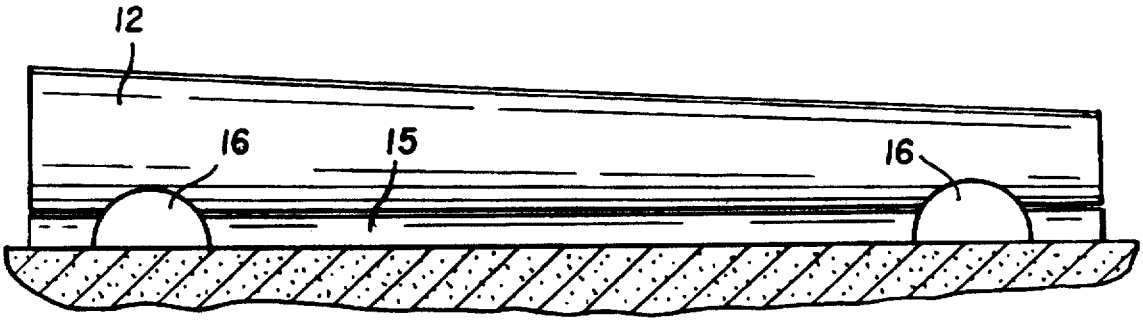
Figure 8A:
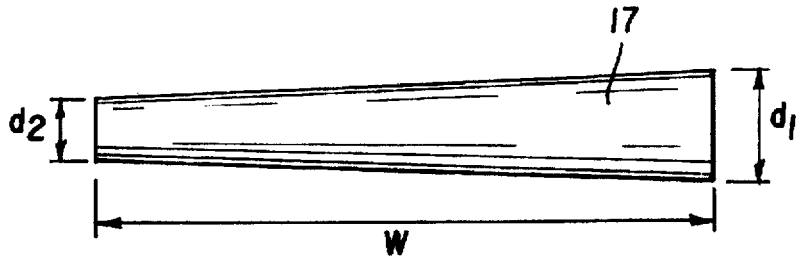
FIG. 8 illustrates the types of prefabricated logs required to build a structure having two rooms.
Figure 8B:
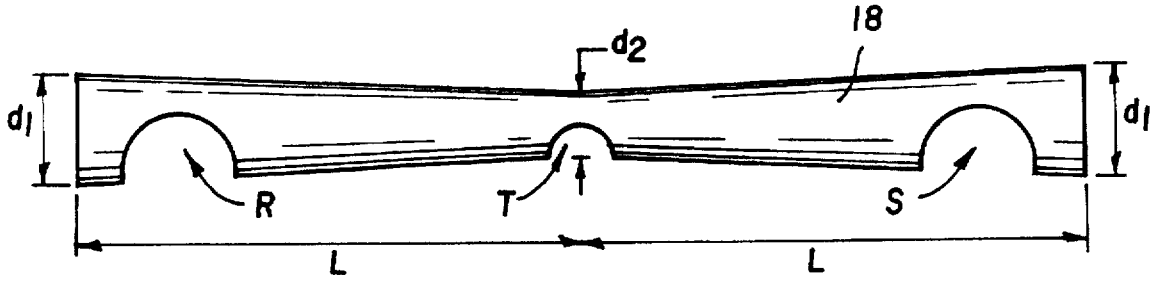
Figure 8C:
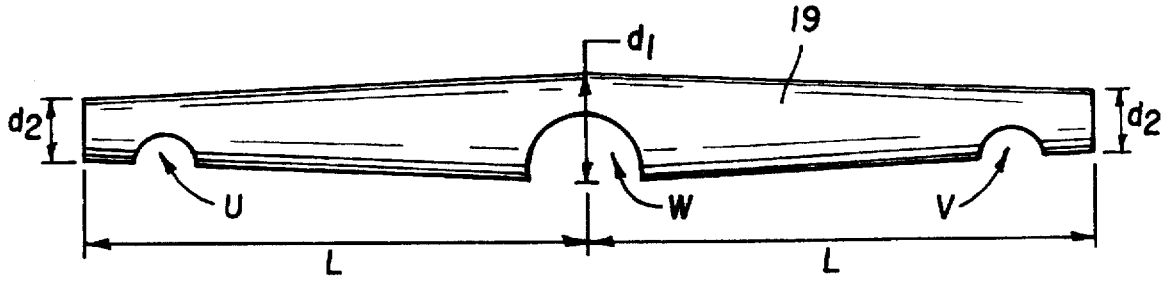
Figure 8D:
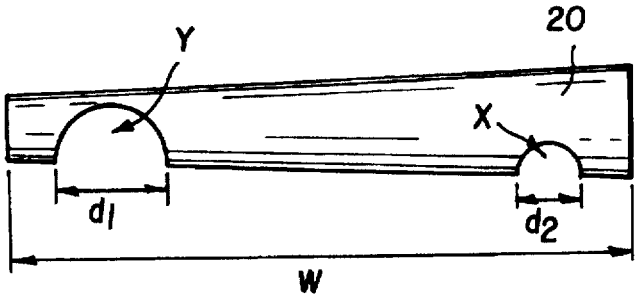

When a foundation is prepared according to the above procedure, it is advisable to mill two notches P and Q into each log of length l 12 prior to placing logs 12 over the sides of length l of the foundation. Notches P and Q are each adapted to be fitted over one of the base logs 16. Notch P is milled into the large end of each log of length l 12, and notch Q is milled into the small end of each log of length l 12. A first log of length l 12 is then placed over the first side of length l of the foundation by fitting notch P of the first log 12 over the first base log 16, and fitting notch Q of the first log 12 over the second base log 16. This is shown in FIG. 7*b*. Next, a second log 12 is then placed over the second side of length l of the foundation by fitting notch P of the second log 12 over the second base log 16, and fitting notch Q of the second log 12 over the first base log 16. After placement of the logs 12, construction proceeds in the manner previously described using notched logs 13 and notched logs 14.

Alternatively, the use of base logs to prepare a foundation may be omitted. In this case, preparation of a foundation simply involves defining a flat rectangular area upon which to build. This may be done if the completed cabin is intended to have a dirt floor.

C) CONSTRUCTION OF A TWO-ROOM STRUCTURE

In a further embodiment, this invention allows the construction of a two-room log cabin of length 21 and width w. In order to construct a two-room log cabin, the following logs are required:

i) three cylindrical logs of length w 17, where each of the three logs 17 has a large end and a small end;

ii) a plurality of cylindrical logs of length 21 18 having two large notches; where a large round saddle notch R is present in a first end of each notched log 18, a large round saddle notch S is present in the second end of each notched log 18, and a small round saddle notch T is present in each notched log 18 at a distance l from its first end; and iii) a plurality of cylindrical logs of length 21 19 having two small notches; where a small round saddle notch U is present in a first end of each notched log 19, a small round saddle notch V is present in the second end of each notched log 19, and a large round saddle notch W is present in each notched log 19 at a distance l from its first end; and iv) a plurality of notched cylindrical logs of length w 20 which each have a large end and a small end; where a round saddle notch X is present in the large end of each notched log 20 and a round saddle notch Y is present in the small end of each notched log 20.

If desired, this set of logs may be packaged as a kit to be sold to a consumer who wishes to construct his own log cabin. In the event that the logs of length 21 are too long to allow for convenient shipping, each log of length 21 may be shipped in two or more pieces. The ends of these pieces may then be butted together to form a single log having the desired length.

In the set of logs described as being useful for construction of a two-room cabin, notches R, S, and W are adapted to fit around either the large end of a log 17 or the large end of a notched log 20. Notches T, U, and V are adapted to fit around either the small end of a log 17 or the small end of a notched log 20. Notches X and Y are adapted to fit around either a log 19 or a log 18.

Logs 18 and logs 19 may have a constant diameter, in which case notches X and Y may be the same size. Alternatively, the diameter of each log of length 21 18 may be $d_1$ at its first end, $d_1$ at its second end and $d_2$ at a distance l from its first end, where $d_1>d_2$. Similarly, the diameter of each log of length 21 19 may be $d_2$ at its first end, $d_2$ at its second end and $d_1$ at a distance l from its first end. In this case, notch X is adapted to fit around a log of diameter $d_2$ and notch Y is adapted to fit around a log of diameter $d_1$. This allows notch X to fit around an end of log 19 or around the center of log 18. Similarly, notch Y will fit around an end of log 18 or around the center of log 19. Logs used in building a two-room cabin are shown in FIG. 8.

Figure 9:
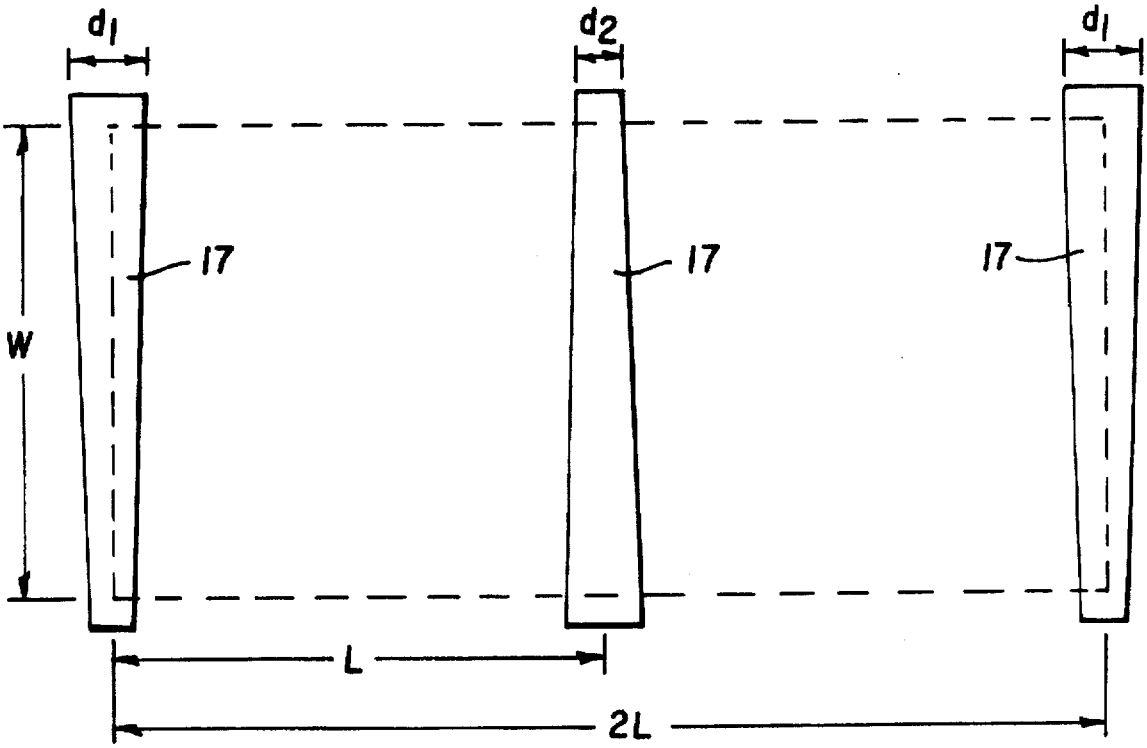
FIG. 9 illustrates the placement of the first three logs used in construction of a structure having two rooms, relative to a foundation of length 2l and width w.

Construction of a two-room cabin begins with the preparation of a foundation of length 21 and width w. The second step in construction involves laying a first log of length w 17 over a first side of length w of the foundation, and laying a second log 17 over a second side of length w of the foundation. A third log 17 is then placed over a line which connects the midpoint of a first side of length 21 of the foundation to the midpoint of the second side of length 21 of the foundation. The logs 17 are positioned so that the large end of the first log 17, the large end of the second log 17, and the small end of the third log 17 each intersect the first side of length 21 of the foundation. Similarly, the small ends of the first and second logs 17 and the large end of the third log 17 each intersect the second side of length 21 of the foundation. This placement of the logs 17 is shown in FIG. 9.

Figure 10A:
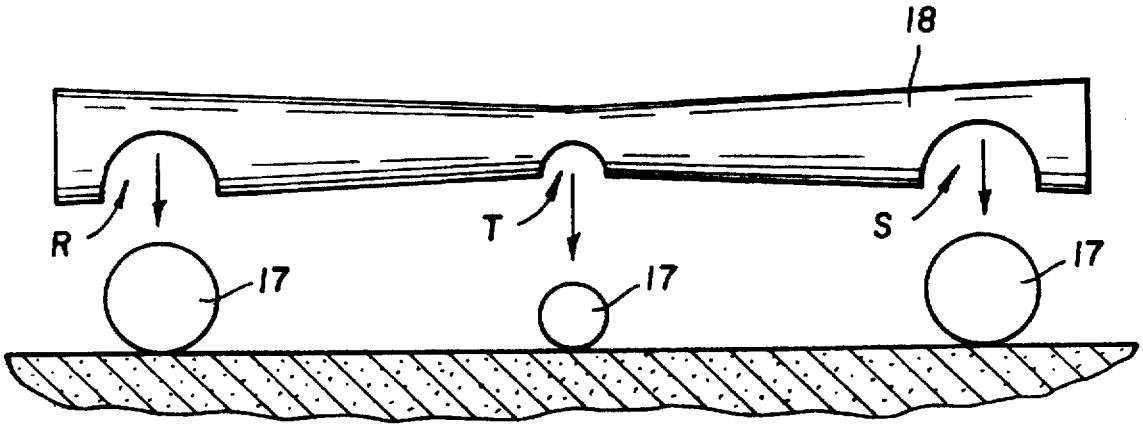
In FIG. 10*a*, the fourth log has two large notches and one small notch, while in FIG. 10*b*, the fourth log has one large notch and two small notches.
Figure 10B:
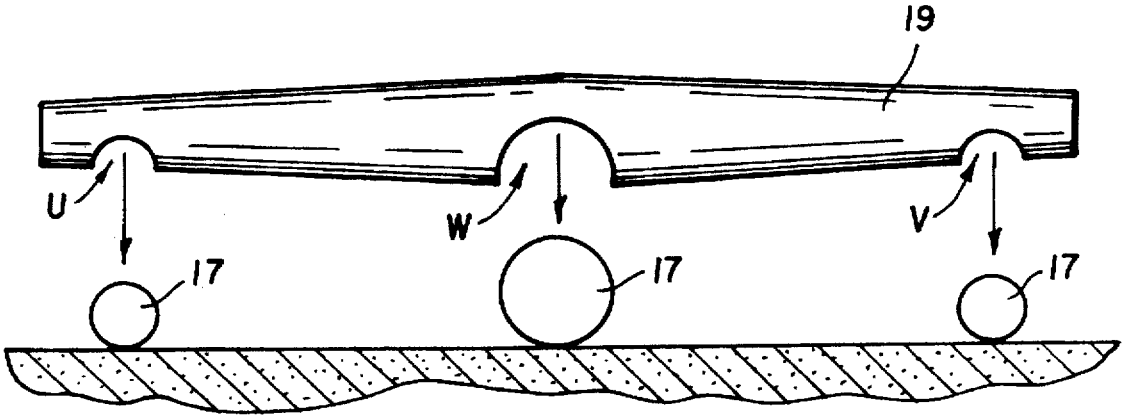
FIG. 10 illustrates how to position a fourth log having three saddle notches over three previously positioned logs which each have a large end and a small end.
Figure 11A:
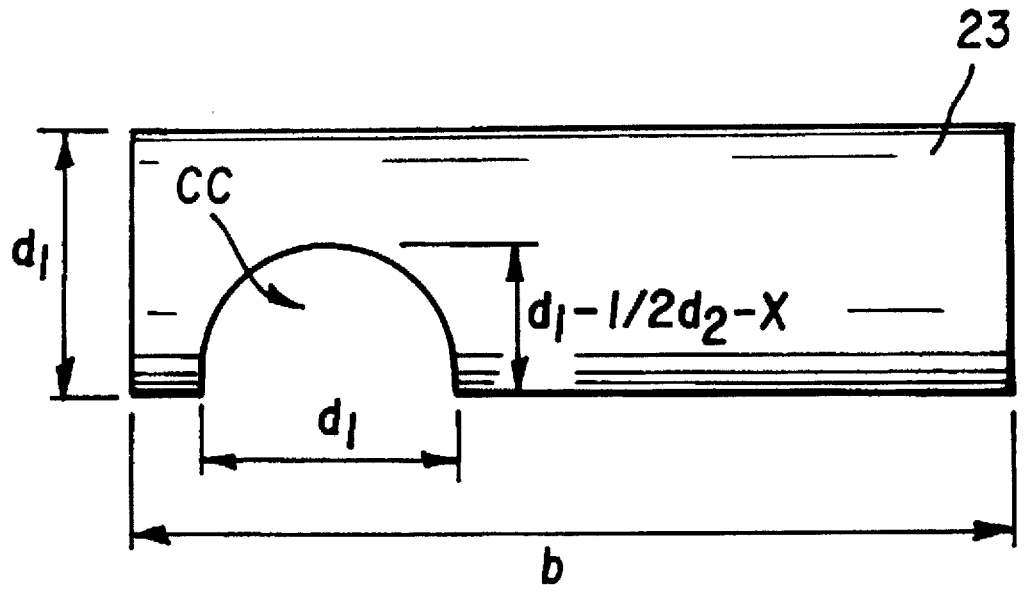
FIG. 11 illustrates the types of prefabricated logs used to form a wall having an opening when constructing a log structure having an opening in one wall.
Figure 11B:
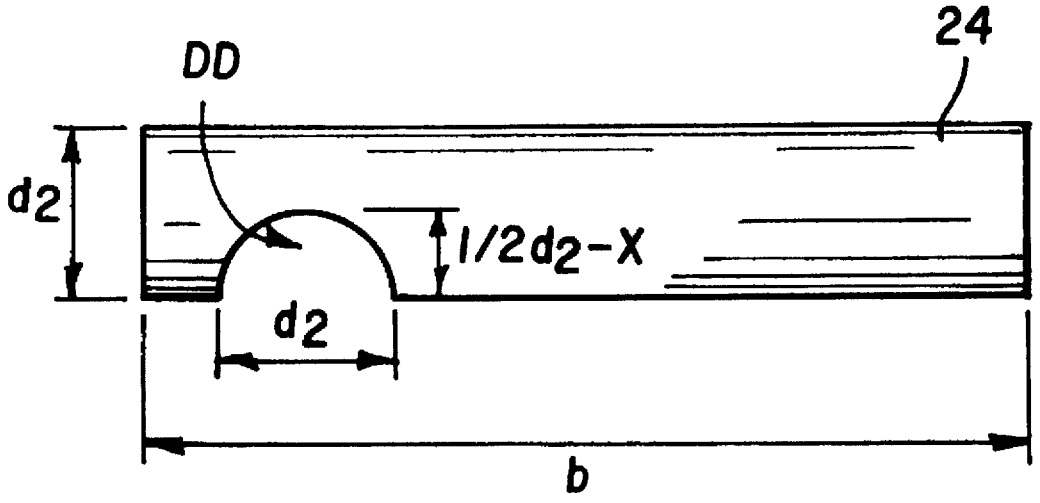
Figure 11C:
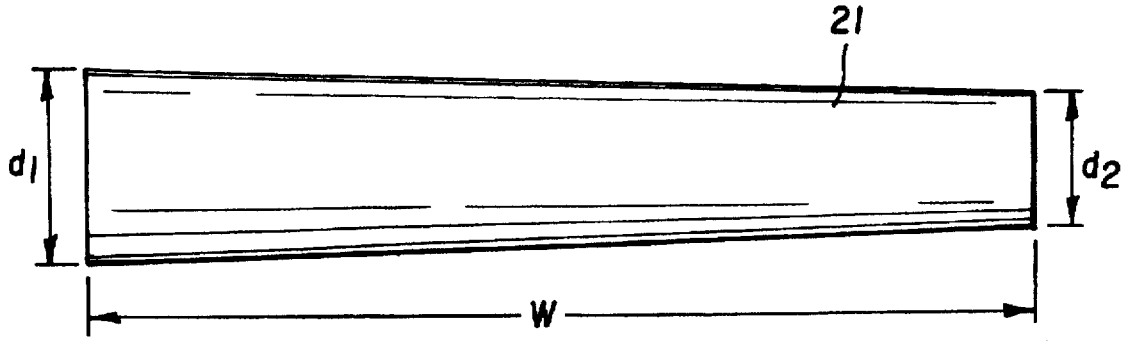
Figure 11D:
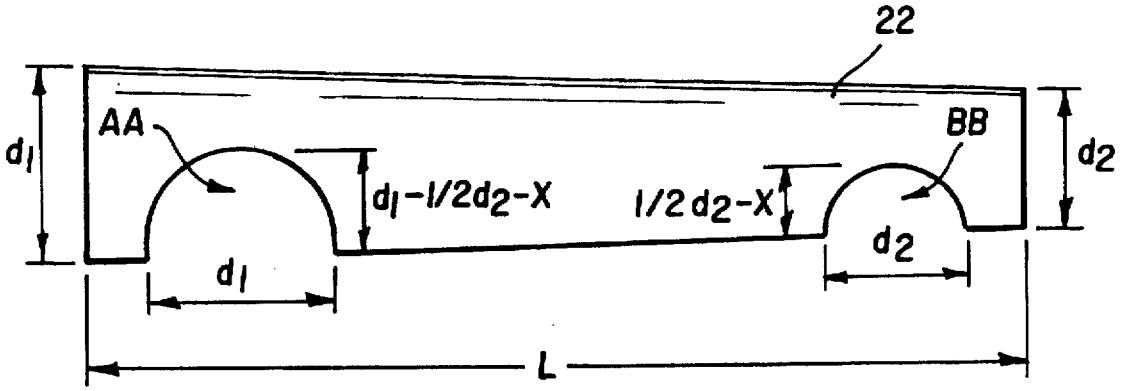
Figure 11E:
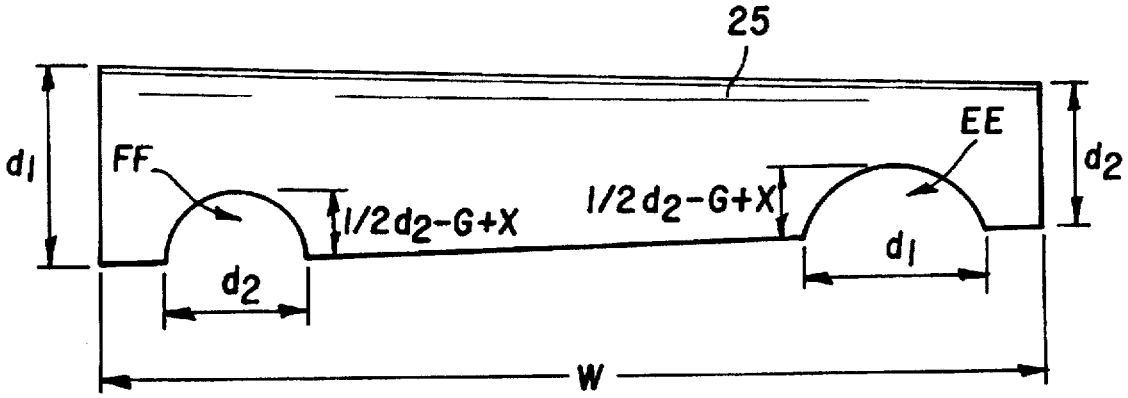

Next, a notched log of length 21 18 is placed over the first side of length 21 of the foundation by fitting large notch R over the large end of the first previously laid log 17, fitting large notch S over the large end of the second previously laid log 17, and fitting small notch T over the small end of the third previously laid log 17, as shown in FIG. 10*a*. A notched log of length 21 19 is then placed over the second side of length 21 of the foundation by fitting small notch U over the small end of the first previously laid log 17, fitting small notch V over the small end of the second previously laid log 17, and fitting large notch W over the large end of the third previously laid log 17, as shown in FIG. 10*b*.

After this, the notches in three notched logs of length w 20 are fitted over logs 18 and 19, so that each log 20 will lie above and parallel to a previously laid log 17. To do this, notch Y in the small end of the first notched log 20 is fitted over a first end of the previously laid log 18 and notch X in the large end of the first notched log of length w 20 is fitted over a first end of the previously laid log 19. A second notched log of length w 20 is laid over the second previously laid log of length w+2x 17 by fitting notch Y of the second log 20 over the second end of log 18 and fitting notch X of the second log 20 over the second end of log 19. However, when a third notched log 20 is placed over the third previously laid log of length w 17, notch Y of the third notched log of length w 20 is fitted over the center of the previously laid log 19 and notch X of the third notched log 20 is fitted over the center of the previously laid log 18.

A second log of length 21 19 is then fitted above the previously laid log of length 21 18 by following the procedure used to lay the previously laid log 21 19 over the second side of length 21 of the foundation. Similarly, a second log 18 is placed over the previously laid log 19 by following the procedure used to lay the previously laid log 18 over the first side of length 21 of the foundation. This process may be continued, with a set of three notched logs of length w 20 and a set of two logs of length 21 18 and 19 being laid alternately in the manner described until a structure having the desired height is obtained.

D) CONSTRUCTION OF A CABIN HAVING AN OPENING IN ONE WALL

Another embodiment of this invention provides a method of building a four-walled structure of length l and width w which has a window or door in one wall. The following logs, which are illustrated in FIG. 11, are required to build this structure:

i) two cylindrical logs of length w 21, where each of the two logs 21 has a large end and a small end;

ii) a plurality of notched cylindrical logs of length l 22 having a large end and a small end, where a large round saddle notch AA adapted to fit around the large end of one of the logs 21 is milled into the large end of each log 22, and a small round saddle notch BB adapted to fit around the small end of one of the logs 21 is milled into the small end of each log 22;

iii) a plurality of notched cylindrical logs of length b 23 which have a large diameter, where 2b+a=l; where a large round saddle notch CC adapted to fit around the large end of one of the logs 21 is milled into one end of each log 23;

iv) a plurality of notched cylindrical logs of length b 24 which have a small diameter; where a small round saddle notch DD adapted to fit around the small end of one of the logs 21 is milled into one end of each log 24; and v) a plurality of notched cylindrical logs of length w 25 having a large end and a small end, where a large round saddle notch EE is milled into the small end of each log 25 and a small round saddle notch FF is milled into the large end of each log 25. Notch EE is adapted to fit around the large end of a notched log 22 or around a large-diameter notched log 23, while notch FF is adapted to fit around the small end of a notched log 22 or around a small-diameter notched log 24.

Construction of a log cabin having a window is started by preparing a rectangular foundation of length l and width w. In the second step, a first of the two logs of length w 21 is positioned over a first side of length w of the foundation. Similarly, a second of the two logs 21 is positioned over a second side of length w of the foundation. The logs of length w are placed so that the large ends of the two logs of length w are positioned on diagonally opposed corners of the foundation.

In the following step, one of the notched logs of length l 22 is positioned over the first side of length l of the foundation by fitting notch AA of the notched log 22 over the large end of the first previously laid logs of length w 21. Notch BB of the log 22 is then fitted over the small end of the second previously laid log 21.

Figure 12:
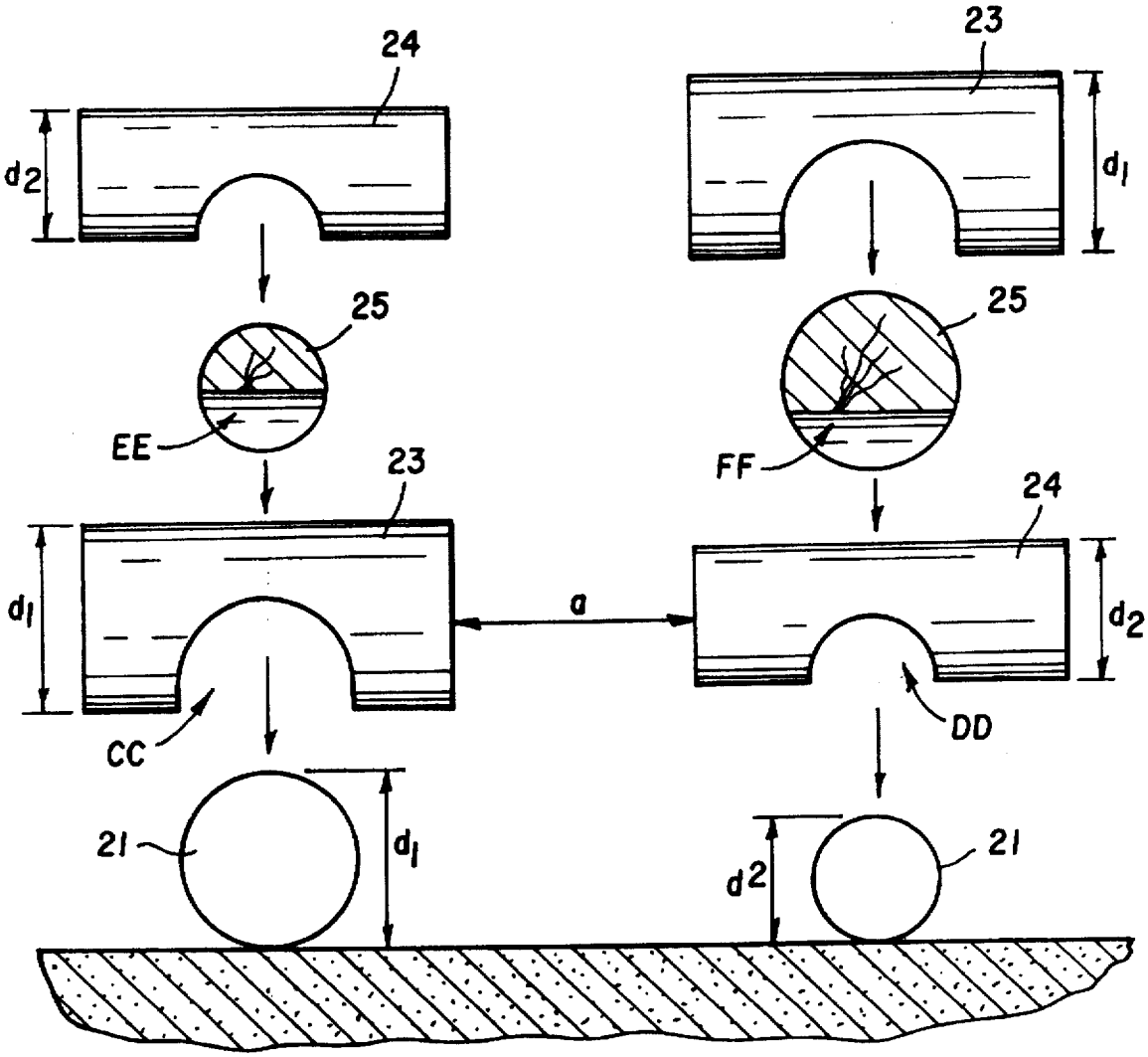
FIG. 12 illustrates construction of a log structure having an opening in one wall.

Up until this point, construction of a log cabin having an opening is basically similarly to construction of a log structure having no opening. The difference between these two construction methods emerges with the fourth step (see FIG. 12). In this step, one of the large-diameter notched logs of length b 23 and one of the small-diameter notched logs of length b 24 are positioned over the second side of length l of the foundation. The large-diameter log is positioned by fitting notch CC over the large end of the second previously laid log of length w 21. Similarly, the small-diameter log 24 is positioned by fitting notch DD over the small end of the first previously laid log 21. At this point, each log of length w 21 has a large notch fitted to its small end and a small notch fitted to its small end.

Next, two notched logs of length w 25 are positioned over the previously laid logs of length w 21. In this step, notch EE of a first notched log 25 is fitted over the large end of the previously laid notched log of length l 22. Notch FF of the same notched log 25 is then fitted over the previously laid small-diameter notched log of length b 24. This first log 25 now lies immediately above and parallel to one of the previously laid logs 21. A second notched log of length w 25 is then positioned over the other of the previously laid logs of length w 21 in a similar fashion. Notch FF of the second notched log 25 is fitted over the small end of the previously laid notched log 21, and notch EE of the second log 25 is fitted over the previously laid large diameter notched log 23. At this point in construction, two walls of length w are defined by two logs of length w 21 and 25 where log 25 is stacked on top of log 21, with the large end of the upper log being positioned over the small end of the lower log.

This process may then be continued if desired, with a notched log of length l 22, two logs of length b 23 and 24, and two logs of length w 25 being laid sequentially until a structure having the desired height is obtained. However, it is important to note that each time an additional log of length l 22 is positioned in the structure, it is positioned on top of a previously positioned notched log of length l 22 so that its large end is above the small end of the previously positioned log. This is done by fitting notch AA of the additional log 22 over the large end of a previously laid log of length w 25, and fitting notch BB of the additional log 22 over the small end of a previously laid log of length w 25. Also, each additional large diameter notched log of length b 23 is laid over a previously positioned small-diameter notched log of length b 24 by fitting notch CC of the additional large-diameter log 23 over the large end of a log 25. In the same manner, each additional small-diameter notched log of length b 24 is positioned over a previously laid large-diameter notched log 23. This is done by fitting notch DD of the additional small-diameter notched log 24 over the small end of a notched log of length w 25.

The above log structures are to be construed as non-limiting examples of the types of structures which may be built using this invention. With a little creativity, a variety of architecturally distinct structures may be constructed using the methods disclosed above.

What is claimed is:

1. A method of stacking logs in a crosswise fashion to form a structure having a plurality of walls, comprising the steps of:

a) obtaining a set of tapered cylindrical logs, wherein said set of logs comprises:

i) a first log having a large end and a small end;

ii) a second log having a large end and a small end; said second log being further characterized in that a large round saddle notch A has been milled by machine into the small end of the second log;

iii) a third log having a large end and a small end; said third log being further characterized in that a small round saddle notch B has been milled by machine into the small end of the third log;

iv) a fourth log having a large end and a small end; said fourth log being further characterized in that a small round saddle notch C has been milled by machine into the large end of the fourth log; and v) a fifth log having a large end and a small end; said fifth log being further characterized in that a large round saddle notch D has been milled by machine into the large end of the fifth log;

b) placing said first log on a flat surface;

c) stacking the second log on the first log by fitting the large notch A in the second log over the large end of the first log;

d) stacking the third log on the second log by fitting the small notch B in the third log over the small end of the second log;

e) stacking the fourth log on the third log by fitting the small notch C in the fourth log over the small end of the third log; and f) stacking the fifth log on the fourth log by fitting the large notch D in the fifth log over the large end of the fourth log.

2. The method of claim 1, further comprising the steps of:

g) obtaining a second set of logs, said second set of logs including:

ii) a sixth log having a large end and a small end; said sixth log being further characterized in that a large round saddle notch A' has been milled by machine into the small end of the sixth log;

iii) a seventh log having a large end and a small end; said seventh log being further characterized in that a small round saddle notch B' has been milled by machine into the small end of the seventh log;

iv) a eighth log having a large end and a small end; said eighth log being further characterized in that a small round saddle notch C' has been milled by machine into the large end of the eighth log; and v) a ninth log having a large end and a small end; said ninth log being further characterized in that a large round saddle notch D' has been milled by machine into the large end of the ninth log;

h) stacking the sixth log on the fifth log by fitting the large notch A' in the sixth log over the large end of the fifth log;

i) stacking the seventh log on the sixth log by fitting the small notch B' in the seventh log over the small end of the sixth log;

j) stacking the eighth log on the seventh log by fitting the small notch C' in the eighth log over the small end of the seventh log;

k) stacking the ninth log on the eighth log by fitting the large notch D' in the ninth log over the large end of the eighth log; and optionally l) repeating steps (g), (h), (i), (j), and (k) sequentially as many times as necessary to obtain a structure having a desired height, providing that each time step (h) is repeated, the large notch A' in the sixth log is fitted over the large end of a ninth log stacked in a previously performed step (k).

3. The method of claim 1, wherein step (a) is further characterized as a step of obtaining a set of tapered cylindrical logs, wherein said set of logs includes:

i) a first log having a large end and a small end;

ii) a second log having a large end, a small end, and a longitudinal axis; said second log being further characterized in that a large round saddle notch A has been milled by machine into the small end of the second log, said notch A forming a defined angle θ with the axis of the second log;

iii) a third log having a large end, a small end, and a longitudinal axis; said third log being further characterized in that a small round saddle notch B has been milled by machine into the small end of the third log, said notch B forming a defined angle θ with the axis of the third log;

iv) a fourth log having a large end, a small end, and a longitudinal axis; said fourth log being further characterized in that a small round saddle notch C has been milled by machine into the large end of the fourth log, said notch C forming a defined angle θ with the axis of the fourth log; and v) a fifth log having a large end, a small end, and a longitudinal axis; said fifth log being further characterized in that a large round saddle notch D has been milled by machine into the large end of the fifth log, said notch D forming a defined angle θ with the axis of the fifth log.

4. The method of claim 3, wherein said step of obtaining a set of tapered cylindrical logs is further characterized in that the defined angle θ is 90°.

5. The method of claim 1, wherein said step of obtaining a set of tapered cylindrical logs is further characterized in that:

i) the first log has a large end of diameter $d_1$ and a small end of diameter $d_2$;

ii) the second log has a large end of diameter $d_1$ and a small end of diameter $d_2$;

iii) the third log has a large end of diameter $d_1$ and a small end of diameter $d_2$;

iv) the fourth log has a large end of diameter $d_1$ and a small end of diameter $d_2$; and v) the fifth log has a large end of diameter $d_1$ and a small end of diameter $d_2$.

6. The method of claim 5, wherein said step of obtaining a set of tapered cylindrical logs is further characterized in that:

i) the second log has a large round saddle notch A having a width of d1 and a depth of $\frac{1}{2} d_2 - G + x$ in its small end;

ii) the third log has a small round saddle notch B having a width of d2 and a depth of $\frac{1}{2} d_2 - x$ in its small end;

iii) the fourth log has a small round saddle notch C having a width of d2 and a depth of $\frac{1}{2} d_2 - G + x$ in its large end; and iv) the fifth log has a large round saddle notch D having a width of d1 and a depth of $d_1 - \frac{1}{2} d_2 - x$ in its large end;

where G is defined as a vertical distance between two adjacent logs in a wall of a log structure, and x is zero or much less than $d_2$.

7. The method of claim 1, additionally comprising the steps of:

l) obtaining a set of base logs, said set of base logs comprising:

i) a first base log having a flat side, a convex side, and a first defined thickness; and ii) a second base log having a flat side, a convex side, and a second defined thickness, where the second defined thickness is greater than said first defined thickness; said second base log being further characterized in that a notch E is present in the flat side of the second base log;

m) placing the first base log on the flat surface so that the flat side of the first base log is in contact with the flat surface; and n) placing the second base log on the flat surface so that the flat side of the second base log is in contact with the flat surface and the notch E in the second base log fits over the convex side of the first base log;

said method being further characterized in that:

i) steps (l), (m), and (n) are performed prior to step (a); and ii) step (b) comprises cutting a notch F into the large end of the first log and placing the first log on top of, and parallel to, the first base log so that the notch F in the first log fits over the convex side of the second base log.

8. A structure built according to the method of claim 1.

9. A method of stacking logs in a crosswise fashion to form a structure having a plurality of walls, comprising the steps of:

a) obtaining a first cylindrical log, where said first log has a large end and a small end;

b) placing said first log on a flat surface;

c) obtaining a set of notched cylindrical logs, wherein said set of cylindrical logs comprises:

i) a second log having a large end and a small end; said second log being further characterized in that a large round saddle notch G has been milled by machine into the small end of the second log;

ii) a third log having a large end and a small end; said third log being further characterized in that a small round saddle notch H has been milled by machine into the large end of the third log; and iii) a fourth log having a large end and a small end; said fourth log being further characterized in that (i) a small round saddle notch I has been milled by machine into the small end of the fourth log, and (ii) a large round saddle notch J has been milled by machine into the large end of the fourth log;

d) stacking the second log on the first log by fitting the large notch G in the second log over the large end of the first log;

e) stacking the third log on the first log by fitting the small notch H in the third log over the small end of the first log;

f) stacking the fourth log on the second log and the third log by fitting the small notch I in the fourth log over the small end of the second log and fitting the large notch J in the fourth log over the large end of the third log; and optionally i) repeating steps (c), (d), (e), and (f) sequentially as many times as necessary to obtain a structure which has a desired height, providing that each time step (d) is repeated, the large notch G in the second log is fitted over the large end of a fourth log stacked in a previously performed step (f), and also that each time step (e) is repeated, the small notch H in the third log is fitted over the small end of a fourth log stacked in a previously performed step (f).

10. The method of claim 9, wherein said step (c) is further characterized as a step of obtaining a set of notched cylindrical logs, wherein said set of logs includes:

i) a second log having a large end, a small end, and a longitudinal axis; said second log being further characterized in that a large round saddle notch G has been milled by machine into the small end of the second log, said notch G forming a defined angle θ with the axis of the second log;

ii) a third log having a large end, a small end, and a longitudinal axis; said third log being further characterized in that a small round saddle notch H has been milled by machine into the small end of the third log, said notch H forming a defined angle θ with the axis of the third log;

iii) a fourth log having a large end, a small end, and a longitudinal axis; said fourth log being further characterized in that (i) a small round saddle notch I has been milled by machine into the large end of the fourth log, said notch I forming a defined angle θ with the axis of the fourth log; and in that (ii) a large round saddle notch J has been milled by machine into the small end of the fourth log, said notch J forming a defined angle θ with the axis of the fourth log.

11. The method of claim 10, wherein said step of obtaining a set of notched cylindrical logs is further characterized in that the defined angle θ is 90°.

12. A structure built according to the method of claim 9.

13. A method of building a four-walled log structure of length l and width w, comprising the steps of:

a) preparing a rectangular foundation having two sides of length l and two sides of length w;

b) obtaining two cylindrical logs of length l, where each of the two logs of length l has a large end and a small end;

c) laying a first one of the two logs of length l over a first side of length l of the foundation and a second one of the two logs of length l over a second side of length l of the foundation, said logs of length l being positioned so that the large end of the first log of length l is diagonally opposed to the large end of the second log of length l;

d) obtaining a set of notched cylindrical logs, said set of logs comprising:

i) two notched cylindrical logs of length w, where each of the two notched logs of length w has a large end and a small end; said notched logs of length w being further characterized in that (i) a large round saddle notch K has been milled by machine into the small end of each notched log of length w and (ii) a small round saddle notch L has been milled by machine into the large end of each notched log of length w;

ii) two notched cylindrical logs of length l, where each of the two notched logs of length l has a large end and a small end; said notched logs of length l being further characterized in that (i) a large round saddle notch M has been milled by machine into the large end of each notched log of length l, and (ii) a small round saddle notch N has been milled by machine into the small end of each notched log of length l;

e) laying (i) a first one of the two notched logs of length w over a first side of length w of the foundation by fitting notch K of the first notched log of length w over the large end of the first previously laid log of length l and fitting notch L of the first notched log of length w over the small end of the second previously laid log of length l and (ii) a second one of the two notched logs of length w over a second side of length w of the foundation by fitting notch K of the second notched log of length w over the large end of the second previously laid log of length l and fitting notch L of the second notched log of length w over the small end of the first previously laid log of length l;

f) laying (i) a first one of the two notched logs of length l over the first previously laid log of length l by fitting notch M of the first notched log of length l over the large end of the first previously laid notched log of length w and fitting notch N of the first notched log of length l over the small end of the second previously laid notched log of length w and (ii) a second one of the two notched logs of length l over the second previously laid log of length l by fitting notch M of the second notched log of length l over the large end of the second previously laid log of length w and fitting notch N of the second notched log of length l over the small end of the first previously laid log of length w; and g) repeating steps (d), (e), and (f) sequentially as many times as necessary to obtain a structure of length l and width w which has a desired height, providing that each time step (e) is repeated, each notch K is fitted over the large end of a notched log of length l laid in a previously performed step (f) and each notch L is fitted over the small end of a notched log of length l laid in a previously performed step (f).

14. The method of claim 13, wherein the method further comprises a step of:

h) obtaining a kit containing the logs of length l, the notched logs of length w, and the notched logs of length l, step (h) being performed prior to step (a); and wherein the logs obtained in step (b) and the set of logs obtained in step (d) are obtained from the kit.

15. The method of claim 13, further characterized in that:

i) each log of length l has a diameter $d_1$ at its large end and a diameter $d_2$ at its small end;

ii) each notched log of length w has a diameter $d_1$ at its large end and a diameter $d_2$ at its small end; and iii) each notched log of length l has a diameter $d_1$ at its large end and a diameter $d_2$ at its small end.

16. The method of claim 15, further characterized in that:

i) notch K has a width of $d_1$ and a depth of less than $\frac{1}{2}$ $d_2-G+x$;

ii) notch L has a width of $d_2$ and a depth of less than $\frac{1}{2}$ $d_2-G+x$;

iii) notch M has a width of $d_1$ and a depth of greater than $d_1-\frac{1}{2}$ $d_2-x$; and iv) notch N has a width of $d_2$ and a depth of greater than $\frac{1}{2}$ $d_2-x$;

where G is defined as a vertical distance between two adjacent logs in a wall of a log structure, and x is zero or much less than $d_2$.

17. The method of claim 13, further characterized in that the step of preparing a foundation comprises the steps of;

a1) defining a flat rectangular area having two sides of length l, two sides of length w, and an exposed upper surface;

a2) obtaining two base logs of length l, where each base log of length l has a flat side, a convex side, and a first defined thickness;

a3) laying a first one of the base logs of length l over a first side of length l of the flat rectangular area and a second one of the base logs of length l over a second side of length l of the flat rectangular area, said base logs of length l being positioned so that the flat side of each of the base logs of length l is in contact with the upper surface of the flat rectangular area;

a4) obtaining two base logs of length w, where each base log of length w has a flat side, a convex side, two ends, and a second defined thickness, with the second defined thickness being greater than the first defined thickness; each log of length w being further characterized in that two notches O have been milled into the flat side of said each log of length l, said notches O being at opposite ends of said each log of length l; and a5) laying (i) a first one of the base logs of length w over a first side of length w of the flat rectangular area by fitting one of the notches O in the flat side of the first base log of length w over the first previously laid base log of length l and fitting the other of the notches O in the flat side of the first base log of length w over the second previously laid base log of length l and (ii) a second one of the base logs of length w over a second side of length w of the flat rectangular area by fitting one of the notches O in the flat side of the second base log of length w over the first previously laid base log of length l and fitting the other of the notches O in the flat side of the second base log of length w over the second previously laid base log of length l.

18. The method of claim 17, where:

i) step (b) is further characterized in that each of the logs of length l has a notch P in its large end and a notch Q in its small end; and ii) step (c) is further characterized as a step of laying the first log of length l over a first side of length l of the foundation by fitting notch P of the first log of length l over the first base log of length w and fitting notch Q of the first log of length l over the second base log of length w, and laying the second log of length l over a second side of length l of the foundation by fitting notch P of the second log of length l over the second base log of length w and fitting notch Q of the second log of length l over the first base log of length w.

19. A method of claim 13, further comprising the step of;

i) cutting an opening into one or more of the walls of the finished structure.

20. A structure built according to the method of claim 13.

21. A method of building a structure having two rooms each of said rooms having a width w and a length l, comprising the steps of:

a) preparing a rectangular foundation having two sides of length w and two sides of length 21;

b) obtaining three cylindrical logs of length w, each of the three logs of length w having a large end and a small end;

c) laying a first one of the logs of length w over a first side of length w of the foundation, laying a second one of the logs of length w over a second side of length w of the foundation, and laying a third one of the logs of length w over a line which connects a midpoint of a first side of length 21 of the foundation to a midpoint of the second side of length 21 of the foundation, said logs of length w being positioned so that the large end of the first log of length w, the large end of the second log of length w, and the small end of the third log of length w each intersect the first side of length 21 of the foundation;

d) obtaining a set of logs, including:

i) a log of length 21 having two large notches, said log of length 21 having two large notches being further characterized in that (i) a large notch R has been milled by machine into a first end of the log of length 21 having two large notches, (ii) a large notch S has been milled by machine into a second end of the log of length 21 having two large notches, and (iii) a small notch T has been milled by machine into the log of length 21 having two large notches at a distance l from its first end;

ii) a log of length 21 having two small notches, said log of length 21 having two small notches being further characterized in that (i) a small notch U has been milled by machine into a first end of the log of length 21 having two small notches, (ii) a small notch V has been milled by machine into a second end of the log of length 21 having two small notches, and (iii) a large notch W has been milled by machine into the log of length 21 having two small notches at a distance l from its first end; and iii) three notched cylindrical logs of length w, where each of the three notched logs of length w has a large end and a small end; said notched logs of length w being further characterized in that (i) a notch Y has been milled by machine into the small end of each notched log of length w and (ii) a notch X has been milled by machine into the large end of each notched log of length w;

e) laying the log of length 21 having two large notches over the first side of length 21 of the foundation by fitting notch R over the large end of the first previously laid log of length w, fitting notch S over the large end of the second previously laid log of length w, and fitting notch T over the small end of the third previously laid log of length w;

f) laying the log of length 21 having two small notches over the second side of length 21 of the foundation by fitting notch U over the small end of the first previously laid log of length w, fitting notch V over the small end of the second previously laid log of length w, and fitting notch W over the large end of the third previously laid log of length w;

g) laying (i) a first one of the three notched logs of length w over the first previously laid log of length w by fitting notch Y of the first notched log of length w over the previously laid log of length 21 having two large notches and fitting notch X of the first notched log of length w over the previously laid log of length 21 having two small notches, (ii) a second one of the three notched logs of length w over the second previously laid log of length w by fitting notch Y of the second notched log of length w over the previously laid log of length 21 having two large notches and fitting notch X of the second notched log of length w over the previously laid log of length 21 having two small notches, and (iii) a third one of the three notched logs of length w over the third previously laid log of length w by fitting notch Y of the third notched log of length w over the previously laid log of length 21 having two small notches and fitting notch Y of the third notched log of length w over the previously laid log of length 21 having two large notches; and optionally h) repeating steps (d), (e), (f), and (g) as many times as necessary to obtain a structure having a desired height, provided that (i) each time step (e) is repeated, the log of length 21 having two large notches is laid over the log of length 21 having two small notches laid in a previously performed step (f) by fitting notch R over the large end of the first notched log of length w laid in a previously performed step (g), fitting notch S over the large end of the second notched log of length w laid in a previously performed step (g), and fitting notch T over the small end of the third notched log of length w laid in a previously performed step (g); and (ii) each time step (g) is repeated, the log of length 21 having two small notches is laid over the log of length 21 having two large notches laid in a previously performed step (e) by fitting notch U over the small end of the first notched log of length w laid in a previously performed step (g), fitting notch V over the small end of the second notched log of length w laid in a previously performed step (g), and fitting notch W over the large end of the third notched log of length w laid in a previously performed step (g).

22. The method of claim 21, further characterized in that:

(i) the log of length 21 having two large notches has a diameter which is essentially constant, and (ii) the log of length 21 having two small notches has a diameter which is essentially constant.

23. The method of claim 21, further characterized in that:

(i) the log of length 21 having two large notches has a diameter which is d1 at its first end, $d_1$ at its second end, and $d_2$ at a distance l from its first end, where $d_1$ is greater than $d_2$; and (ii) the log of length 21 having two small notches has a diameter which is $d_2$ at its first end, $d_2$ at its second end, and $d_1$ at a distance l from its first end.

24. The method of claim 21, further characterized in that the log of length 21 having two large notches and the log of length 21 having two small notches are each assembled from two shorter logs by placing an end of one of the shorter logs in contact with an end of the other of the shorter logs.

25. A structure built according to the method of claim 21.

26. A method of building a four-walled structure of length l and width w having an opening of width a in a wall of length l, comprising the steps of:

a) preparing a rectangular foundation having two sides of length l and two sides of length w;

b) obtaining two cylindrical logs of length w, where each of the two logs of length w has a large end and a small end;

c) laying a first one of the two logs of length w over a first side of length w of the foundation and a second one of the two logs of length w over a second side of length w of the foundation, said logs of length w being positioned so that the large end of the first log of length w is diagonally opposed to the large end of the second log of length w;

d) obtaining a set of logs, comprising:

i) a notched cylindrical log of length l, where the notched log of length l has a large end and a small end; said notched log of length l being further characterized in that (i) a large round saddle notch AA has been milled by machine into the large end of the notched log of length l and (ii) a small round saddle notch BB has been milled by machine into the small end of the notched log of length l;

ii) two notched cylindrical logs of length b, where 2b+a=l; the two notched logs of length b being further characterized in that a first notched log of length b has a large diameter and a second notched log of length b has a small diameter, and also in that (i) a large round saddle notch CC has been milled by machine into a first end of the first notched log of length b, and (ii) a small round saddle notch DD has been milled by machine into a first end of the second notched log of length b; and iii) two notched cylindrical logs of length w, where each of the two notched logs of length w has a large end and a small end; said notched logs of length w being further characterized in that (i) a large round saddle notch EE has been milled by machine into the small end of each notched log of length w and (ii) a small round saddle notch FF has been milled by machine into the large end of each notched log of length w:

e) laying the notched log of length l over the first side of length l of the foundation by fitting notch AA of the notched log of length l over the large end of one of the previously laid logs of length w and fitting notch BB of the notched log of length l over the small end of the other previously laid log of length w;

f) laying the first notched log of length b and the second notched log of length b over a second side of length l of the foundation by fitting notch CC of the first notched log of length b over the large end of the second previously laid log of length w and fitting notch DD of the second notched log of length b over the small end of the first previously laid log of length w, where the first notched log of length b and the second notched log of length b are positioned so that they are separated by a distance a;

g) laying (i) a first one of the two notched logs of length w over one of the previously laid logs of length w by fitting notch EE of the first notched log of length w over the large end of the previously laid notched log of length l and fitting notch FF of the first notched log of length w over the second previously laid notched log of length b and (ii) a second one of the two notched logs of length w over the other of the previously laid logs of length w by fitting notch FF of the second notched log of length w over the small end of the previously laid notched log of length l and fitting notch EE of the second notched log of length w over the first previously laid notched log of length b;

j) repeating steps (d), (e), (f), and (g) sequentially as many times as necessary to obtain a structure of length l and width w which has a desired height, providing that (i) each time step (e) is repeated, notch AA is fitted over the large end of a notched log of length w laid in a previously performed step (g) and notch BB is fitted over the small end of a notched log of length w laid in a previously performed step (g), and (ii) each time step (f) is repeated, the first notched log of length b is laid over a second notched log of length b laid in a previously performed step (f) by fitting notch CC of the first notched log of length b over the large end of a notched log of length w laid in a previously performed step (g), and the second notched log of length b is laid over a first notched log of length b laid in a previously performed step (f) by fitting notch DD of the second notched log of length b+x over the small end of a notched log of length w laid in a previously performed step (g).

27. A structure built according to the method of claim 26.

* * * * *